US010022682B2

(12) United States Patent
Hata

(10) Patent No.: US 10,022,682 B2
(45) Date of Patent: Jul. 17, 2018

(54) SUPER-MICRO BUBBLE GENERATOR

(75) Inventor: Takashi Hata, Kochi (JP)

(73) Assignee: INSTITUTE OF NATIONAL COLLEGES OF TECHNOLOGY, JAPAN, Tokyo (JP)

( * ) Notice: Subject to any disclaimer, the term of this patent is extended or adjusted under 35 U.S.C. 154(b) by 382 days.

(21) Appl. No.: 13/982,583

(22) PCT Filed: Jan. 31, 2012

(86) PCT No.: PCT/JP2012/052095
§ 371 (c)(1),
(2), (4) Date: Sep. 5, 2013

(87) PCT Pub. No.: WO2012/105536
PCT Pub. Date: Aug. 9, 2012

(65) Prior Publication Data

US 2014/0010040 A1 Jan. 9, 2014

(30) Foreign Application Priority Data

Jan. 31, 2011 (JP) ..... 2011-018504

(51) Int. Cl.
*B01F 3/04* (2006.01)
*B01F 5/04* (2006.01)
*B01F 5/00* (2006.01)

(52) U.S. Cl.
CPC ..... *B01F 3/0446* (2013.01); *B01F 3/04503* (2013.01); *B01F 5/043* (2013.01);
(Continued)

(58) Field of Classification Search
CPC ..... B01F 5/0413; B01F 5/0428; B01F 2005/0436; B01F 3/0446; B01F 3/04503; B01F 2003/04959; B01F 2005/0017
(Continued)

(56) References Cited

U.S. PATENT DOCUMENTS 2,020,850 A 11/1935 Myhren et al.
4,026,817 A * 5/1977 Ciuti ..... B01F 5/0473 366/163.2
(Continued)

FOREIGN PATENT DOCUMENTS

EP 2060319 A1 * 5/2009 ..... B01F 3/0446
GB 1205675 1/1968
(Continued)

OTHER PUBLICATIONS

International Search Report, PCT Appln. Serial No. PCT/JP2012/052095 dated Apr. 3, 2012, 3 pages—Japanese; 3 pages—English.
(Continued)

*Primary Examiner* — Walter Dean Griffin
*Assistant Examiner* — Marc C Howell
(74) *Attorney, Agent, or Firm* — Andrew F. Young, Esq.; Lackenbach Siegel, LLP

(57) ABSTRACT

To generate homogenized super-micro bubbles of nano-scale in a simple structure and at a low cost, a super-micro bubble generator has a cylindrical casing provided with an opening for the introduction of a liquid at one end and an outlet for delivery of the liquid at the other end, and the cylindrical casing includes: a flow speed increasing part for increasing the flow speed of the liquid introduced from the introduction opening; a gas suction part for drawing gas from the outside into the casing, wherein the pressure is decreased by a liquid flow whose flow speed is increased in the flow speed increasing part; and a super-micro bubble-containing liquid producing part for shearing, by the liquid flow whose flow speed is increased in the flow speed increasing part, the gas that is sucked by the gas suction part and generating a liquid including super-micro bubbles, in this order, from the introduction opening to the delivery opening.

2 Claims, 15 Drawing Sheets

(52) U.S. Cl.
CPC ..... *B01F 2003/04858* (2013.01); *B01F 2005/0017* (2013.01)

(58) Field of Classification Search
USPC ..... 366/163.2
See application file for complete search history.

(56) References Cited

U.S. PATENT DOCUMENTS

| | | | | |
|---|---|---|---|---|
| 4,133,485 | A * | 1/1979 | Bouvin | B01F 5/0614 138/42 |
| 5,863,128 | A * | 1/1999 | Mazzei | B01F 5/0415 137/888 |
| 2006/0245296 | A1* | 11/2006 | Nishioka | B01D 53/8631 366/174.1 |
| 2009/0314702 | A1* | 12/2009 | Mazzei | B01F 3/0446 210/199 |

FOREIGN PATENT DOCUMENTS

| | | |
|---|---|---|
| JP | H06165806 | 6/1994 |
| JP | 2002301345 | 10/2002 |
| JP | 2007021343 | 2/2007 |
| JP | 1009018579 | 2/2009 |
| WO | WO 99/28022 | 6/1999 |

OTHER PUBLICATIONS

Extended European Search Report, EP Pat. No. 12742377.0 dated Mar. 6, 2018, 8 pages—English.

* cited by examiner

SUPER-MICRO BUBBLE GENERATOR

CROSS REFERENCE TO RELATED APPLICATIONS

This application claims priority to International Ser. No. PCT/JP2012/052095 filed Jan. 31, 2012, the entire contents of which are incorporated herein fully by reference, which in turn claims priority to JP Ser. No. JP 2011-018504, filed on Jan. 31, 2011.

TECHNICAL FIELD

The present invention relates to a super-micro bubble generator which can produce a gas-liquid mixed phase by mixing a gas which forms a dispersion phase and a liquid which forms a continuous phase with each other and can generate dispersed bubbles super-finely and homogeneously.

BACKGROUND ART

Conventionally, as a mode of a super-micro bubble generator, there has been known a super-micro bubble generator disclosed in patent literature 1. That is, patent literature 1 discloses a micro-bubble generating device where in the inside of a cylindrical casing body which has an introduction opening through which a liquid is introduced therein on one end thereof and a delivery opening through which the liquid is delivered therefrom on the other end thereof, a gas-liquid mixing part; an enlarged diameter flow path forming part; a swirl flow forming part; and a temporarily retaining part are arranged sequentially toward the delivery opening from the introduction opening. In the gas-liquid mixing part, a gas is introduced into the inside of the casing body through a suction opening formed in a peripheral wall of the casing body and is mixed with the liquid. In the enlarged diameter flow path forming part, the diameter of the enlarged diameter flow path forming part is gradually enlarged toward a delivery opening side from the gas-liquid mixing part. The swirl flow forming part is connected to a terminal end portion of the enlarged diameter flow path forming part, and forms a gas-liquid mixed phase into a swirl flow. The temporarily retaining part temporarily retains a swirl flow formed by the swirl flow forming part.

Micro bubbles are generated by the micro bubble generating device as follows. That is, a liquid introduced into the casing body through the introduction opening and a gas introduced into the casing body through the suction opening are mixed together in the gas-liquid mixing part thus forming a gas-liquid mixed phase. The gas-liquid mixed phase is made to pass through the enlarged diameter flow path forming part so that the gas-liquid mixed phase is decelerated whereby a gas-liquid mixture flow is formed. The gas-liquid mixture flow is guided to the swirl flow forming part and is formed into a swirl flow. At this stage, the gas which forms the gas-liquid mixture flow is dispersed in the form of fine gas bubbles. Then, the swirl flow is temporarily retained while flowing in the temporarily retaining part so that relatively large bubbles are crushed. Thereafter, the swirl flow containing fine bubbles (micro bubbles) is delivered from the delivery opening.

CITATION LIST

Patent Literature

PTL 1: JP-A-2007-21343

SUMMARY OF INVENTION

Technical Problem

Although the above-mentioned micro bubble generator can generate bubbles at a micro-scale level (several tens to several hundreds μm) in size, but cannot generate finer and homogenized bubbles at a nano-scale level (less than 1 μm) in size. Accordingly, such a micro bubble generating device has a drawback that the micro bubble generating device cannot be used in industrial fields where bubbles at a nano-scale level in size are needed.

Accordingly, it is an object of the present invention to provide a super-micro bubble generator which can generate super-micro homogenized bubbles of nano-scale level with the simple structure at a low cost.

Solution to Problem

A super-micro bubble generator according to the invention called for in the claims is characterized by providing, in a cylindrical casing body having an introduction opening for the introduction of a liquid at one end thereof and a delivery opening for delivery of the liquid at the other end thereof, in the order from the introduction opening to the delivery opening, a flow speed increasing part for increasing a flow speed of the liquid introduced from the introduction opening; a gas suction part for sucking a gas into the casing body from the outside, wherein a pressure in the casing body is decreased by a liquid flow whose flow speed is increased by the flow speed increasing part; and a super-micro bubble-containing liquid producing part for producing a liquid into which super-micro bubbles are mixed by shearing the gas that is sucked by the gas suction part with the liquid flow whose flow speed is increased by the flow speed increasing part.

In such a super-micro bubble generator, a flow speed of a liquid introduced from the introduction opening can be increased by the flow speed increasing part. Here, a pressure at the flow speed increasing part in the inside of the casing body is lowered due to a liquid flow whose flow speed is increased by the flow speed increasing part. Accordingly, a gas can be sucked from the outside by a Venturi effect at the gas suction part. Further, at the super-micro bubble-containing liquid producing part, the gas sucked at the gas suction part is sheared by the liquid flow whose flow speed is increased by the flow speed increasing part so that a liquid into which super-micro bubbles are mixed is generated.

The super-micro bubble generator according to the invention called for in claim 2 is, in the super-micro bubble generator according to the invention called for in the claims, characterized in that the flow speed increasing part includes: a flow speed increasing flow path which has a flow path cross section smaller than a flow path cross section of the casing body and extends coaxially with an axis of the casing body;

the gas suction part includes: a gas suction opening which is formed in a middle portion of a peripheral wall of the casing body; and a gas suction flow path which has a proximal end portion thereof communicated with the gas suction opening and extends concentrically on the outer periphery of the flow speed increasing flow path, and the super-micro bubble-containing liquid producing part includes a super-micro bubble-containing liquid producing flow path where a distal end portion of the gas suction flow path and a distal end portion of the flow speed increasing flow path are communicated with each other, and the super-micro bubble-containing liquid producing flow path extends toward the delivery opening.

In such a super-micro bubble generator, the flow speed increasing flow path which the flow speed increasing part includes has a flow path cross section smaller than a flow path cross section of the casing body and extends coaxially with the axis of the casing body and hence, a flow speed of a liquid flow can be surely increased. Further, a gas can be sucked from the gas suction opening which the gas suction part includes and the gas is made to concentrically flow into the outer periphery of the flow speed increasing flow path through the gas suction flow path. In the super-micro bubble-containing liquid producing flow path which the super-micro bubble-containing liquid producing part includes, a liquid which forms a liquid flow whose flow speed is increased and a gas which flows in a surrounding manner around the outer periphery of the liquid are mixed with each other. Here, an outer peripheral portion of the liquid which forms the flow-speed increased liquid flow where a flow speed is high imparts a shearing force to the gas which flows on the outer periphery of the liquid. As a result, in the super-micro bubble-containing liquid producing flow path, a liquid into which homogenized super-micro bubbles are mixed can be efficiently and surely generated and can be delivered from the delivery opening.

A super-micro bubble generator according to the invention called for in the claims is characterized by providing, in a cylindrical casing body having an introduction opening for the introduction of a liquid at one end thereof and a delivery opening for the delivery of the liquid at the other end thereof, in the order from the introduction opening to the delivery opening, a swirl flow forming part for forming the liquid introduced from the introduction opening into a swirl flow; a flow speed increasing part for increasing a flow speed of the swirl flow formed by the swirl flow forming part; a gas suction part for sucking a gas into the casing body from the outside, wherein a pressure in the casing body is decreased by a swirl flow whose flow speed is increased by the flow speed increasing part; and a super-micro bubble-containing liquid producing part for producing a liquid into which super-micro bubbles are mixed by shearing the gas that is sucked by the gas suction part with the swirl flow whose flow speed is increased by the flow speed increasing part.

In such a super-micro bubble generator, a liquid introduced from the introduction opening can be formed into a swirl flow by the swirl flow forming part. Then, a flow speed of the swirl flow formed by the swirl flow forming part can be increased by the flow speed increasing part. Here, a pressure at the flow speed increasing part in the inside of the casing body is lowered due to a swirl flow whose flow speed is increased by the flow speed increasing part. Accordingly, a gas can be sucked from the outside by a Venturi effect at the gas suction part. Further, at the super-micro bubble-containing liquid producing part, the gas sucked at the gas suction part is sheared by the swirl flow whose flow speed is increased by the flow speed increasing part so that a liquid into which super-micro bubbles are mixed is generated.

The super-micro bubble generator according to the invention called for in the claims is, in the super-micro bubble generator according to the invention called for in the claims, characterized in that the swirl flow forming part includes: a swirl flow means which forms a liquid passing through the swirl flow means into a swirl flow; and a swirl flow guide flow path which extends toward a downstream side of the swirl flow means along an axis of the casing body, the flow speed increasing part includes: a flow speed increasing flow path which has a flow path cross section smaller than a flow path cross section of the swirl flow guide flow path and extends coaxially with the axis of the casing body; the gas suction part includes: a gas suction opening which is formed in a middle portion of a peripheral wall of the casing body; and a gas suction flow path which has a proximal end portion thereof communicated with the gas suction opening and extends concentrically on the outer periphery of the flow speed increasing flow path, and the super-micro bubble-containing liquid producing part includes a super-micro bubble-containing liquid producing flow path where a distal end portion of the gas suction flow path and a distal end portion of the flow speed increasing flow path are communicated with each other, the super-micro bubble-containing liquid producing flow path extends toward the delivery opening.

In such a super-micro bubble generator, the swirl flow means of the swirl flow forming part forms a liquid passing through the swirl flow forming part into a swirl flow, and the swirl flow guide flow path which extends along the axis of the casing body at the downstream side of the swirl flow means guides the swirl flow downward. The flow speed increasing flow path which the flow speed increasing part includes has a flow path cross section smaller than a flow path cross section of the swirl flow guide flow path and extends coaxially with the axis of the casing body and hence, a flow speed of a swirl flow can be surely increased. A gas is sucked from the gas suction opening which the gas suction part includes, and the gas can be made to concentrically flow into the outer periphery of the flow speed increasing flow path through the gas suction flow path. In the super-micro bubble-containing liquid producing flow path which the super-micro bubble-containing liquid producing part includes, a liquid which forms a swirl flow and a gas which flows in a surrounding manner around the outer periphery of the liquid are mixed with each other. Here, an outer peripheral portion of the liquid which forms the swirl flow where a swirl strength is large imparts a high shearing force to the gas which flows on the outer periphery of the liquid. As a result, in the super-micro bubble-containing liquid producing flow path, a liquid into which homogenized super-micro bubbles are mixed can be efficiently and surely generated and can be delivered from the delivery opening.

The super-micro bubble generator according to the invention called for in the claims is, in the super-micro bubble generator according to the invention called for in the claims, characterized in that the casing body includes: a first division member having a cylindrical shape; a second division member having a cylindrical shape which is fitted on a distal end portion of an outer peripheral surface of the first division member; a third division member having a cylindrical shape which is fitted on a distal end portion of an inner peripheral surface of the second division member; a fourth division member having a cylindrical shape which is fitted on a distal end portion of an outer peripheral surface of the third division member; and a fifth division member having a cylindrical shape which is fitted on a distal end portion of an inner peripheral surface of the fourth division member, wherein the fourth division member is formed with a diameter thereof on a distal end portion side set smaller than the diameter thereof on a proximal end portion side with a diameter decreasing portion which constitutes a middle portion of the fourth division member interposed between the distal end portion side and the proximal end portion side, the swirl flow means includes: a support member having a cylindrical shape which is fitted on a middle portion of the inner peripheral surface of the second division member; and a swirl flow forming member which is formed in the axial direction in an extending manner from an edge portion of a distal end of the support member, the support member being sandwiched in the axial direction by the first division member and the third division member in the inside of the second division member, the flow speed increasing flow path is formed by arranging a flow speed increasing flow path forming body which includes: a flow path forming member having a cylindrical shape which has an outer diameter thereof smaller than an inner diameter of a distal end portion side of the fourth division member; and an umbrella-shaped support member which is formed in a projecting manner toward a downstream side from a proximal end portion of an outer peripheral surface of the flow path forming member in the inside of the fourth division member, a peripheral portion of a distal end of the umbrella-shaped support member is brought into contact with the diameter decreasing portion of the fourth division member, and a distal end portion of the flow path forming member is arranged concentrically in the inside of a distal end portion of the fourth division member, and the gas suction flow path is formed in a cylindrical shape in a gap formed between an outer peripheral surface of the flow path forming member and an inner peripheral surface of the distal end portion of the fourth division member.

In such a super-micro bubble generator, the casing body is formed by connecting the first to fifth division members all having a cylindrical shape with each other in fitting engagement. Further, the fourth division member is formed the fourth division member is formed with the diameter thereof on the distal end portion side set smaller than the diameter thereof on the proximal end portion side with the diameter decreasing portion which constitutes the middle portion of the fourth division member interposed between the distal end portion side and the proximal end portion side.

Due to such a constitution, by fitting the support member having a cylindrical shape of the swirl means on the middle portion of the inner peripheral surface of the second division member and by sandwiching the support member by the first division member and the third division member in the inside of the second division member in the axial direction, the swirl means can be easily positioned.

The flow speed increasing flow path is formed by arranging the speed increasing flow path forming body in the inside of the fourth division member. That is, the speed increasing flow path forming body includes the flow path forming member having a cylindrical shape which has an outer diameter thereof smaller than an inner diameter of the distal end portion side of the fourth division member; and the umbrella-shaped support member which is formed in a projecting manner toward the downstream side form the proximal end portion of the outer peripheral surface of the flow path forming member.

Due to such a constitution, a peripheral portion of a distal end of the umbrella-shaped support member can be brought into contact with the diameter decreasing portion of the fourth division member, and a distal end portion of the flow path forming member can be concentrically arranged in the inside of a distal end portion of the fourth division member. Accordingly, the gas suction flow path can be cylindrically formed in a gap formed between an outer peripheral surface of the flow path forming member and an inner peripheral surface of the distal end portion of the fourth division member. That is, by merely arranging the speed increasing flow path forming body in the inside of the fourth division member, the swirl flow guide flow path, the flow speed increasing flow path, the gas suction flow path and the super-micro bubble-containing liquid producing flow path can be easily and surely formed in a partitioned manner. Accordingly, an outer periphery of a liquid which forms a swirl flow whose flow speed is increased is cylindrically surrounded by a sucked gas. An outer peripheral portion of a swirl flow having a high swirl strength imparts a high shearing force to the cylindrical gas which surrounds the swirl flow from the inside. That is, not at the center side of the swirl flow but at the outer peripheral side of the swirl flow where a swirl strength is relatively strong compared to the center side, a high shearing force can be applied to the whole inner peripheral surface of the cylindrical gas which surrounds the outer periphery of the swirl flow. Accordingly, in the super-micro bubble-containing liquid producing flow path, the sucked gas can be efficiently made fine and homogenized at a super micro level. As a result, in the super-micro bubble-containing liquid producing flow path, a liquid containing homogenized super-micro bubbles can be surely generated.

Advantageous Effects of Invention

The present invention acquires the following advantageous effects. That is, the super-micro bubble generator according to the present invention can stably generate a large amount of homogenized super-micro bubbles of nano-scale level (less than 1 μm) within a short time. Further, the light-weighted and compact super-micro bubble generator can be manufactured at a low cost using a synthetic resin. Accordingly, the super-micro bubble generator is broadly used in industrial fields where bubbles of nano-scale level are required.

MODE FOR CARRYING OUT THE INVENTION

Hereinafter, a first embodiment and a second embodiment of the present invention are explained in conjunction with drawings.

First Embodiment

Figure 1:
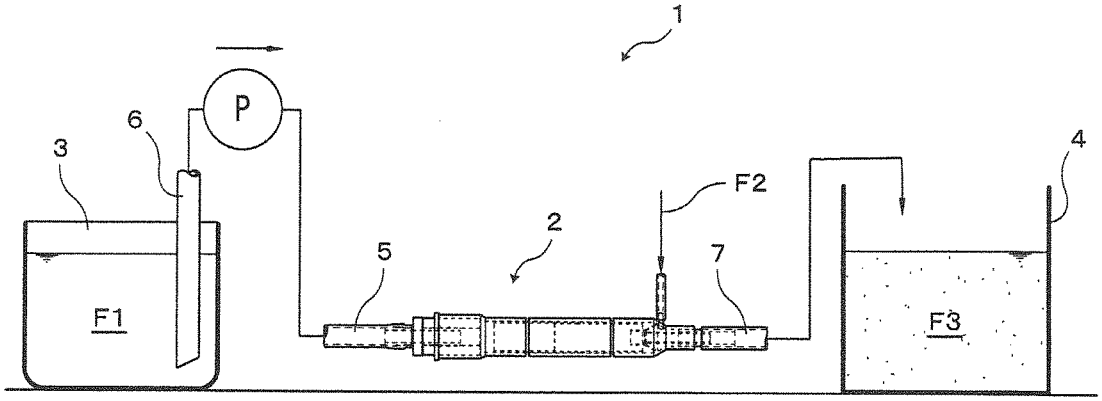
FIG. 1 is an explanatory view of a super-micro bubble generating device according to a first embodiment.

Symbol 1 shown in FIG. 1 indicates a super-micro bubble generating device according to a first embodiment, and the super-micro bubble generating device 1 is, as shown in FIG. 1, a device which mixes a liquid F1 forming a continuous phase and a gas F2 forming a dispersion phase with each other, and forms the gas F2 into super-micro homogenized bubbles thus generating a mixed fluid F3 having a gas-liquid mixed phase. In this embodiment, the liquid F1 is water and the gas F2 is air. The mixed fluid F3 is a liquid into which super-micro bubbles are mixed (super-micro bubble containing liquid).

(Explanation of Super-Micro Bubble Generating Device 1 According to First Embodiment)

The super-micro bubble generating device 1 according to the first embodiment includes, as shown in FIG. 1, a super-micro bubble generator 2 according to the first embodiment, a liquid storing portion 3 which stores therein the liquid F1 to be supplied to the super-micro bubble generator 2, and a mixed fluid storing portion 4 which stores therein the mixed fluid F3 produced by the super-micro bubble generator 2. A delivery opening (not shown in the drawing) of a pump P is communicably connected to one end side (proximal end side) of the super-micro bubble generator 2 byway of a first communication pipe 5 which constitutes a first communication path. The liquid storing portion 3 which stores the liquid F1 therein is communicably connected to a suction opening (not shown in the drawing) of the pump P by way of a second communication pipe 6 which constitutes a second communication path. The mixed fluid storing portion 4 which stores the mixed fluid F3 therein is communicably connected to the other end side (distal end side) of the super-micro bubble generator 2 by way of a third communication pipe 7 which constitutes a third communication path.

Due to such a constitution, by operating the pump P, the liquid F1 in the liquid storing portion 3 is sucked into the pump P from the suction opening of the pump P through the second communication pipe 6, and the liquid F1 can be delivered to the super-micro bubble generator 2 from the delivery opening of the pump P. While the pressurized liquid F1 is introduced into the super-micro bubble generator 2, the gas F2 is separately sucked into the super-micro bubble generator 2, and the liquid F1 and the gas F2 are mixed with each other in the super-micro bubble generator 2 so that the mixed fluid F3 is produced. The mixed fluid F3 is stored in the mixed fluid storing portion 4 through the third communication pipe 7. Further, the mixed fluid F3 can be recovered from the mixed fluid storing portion 4.

(Explanation of Super-Micro Bubble Generator 2 According to First Embodiment)

Figure 2:
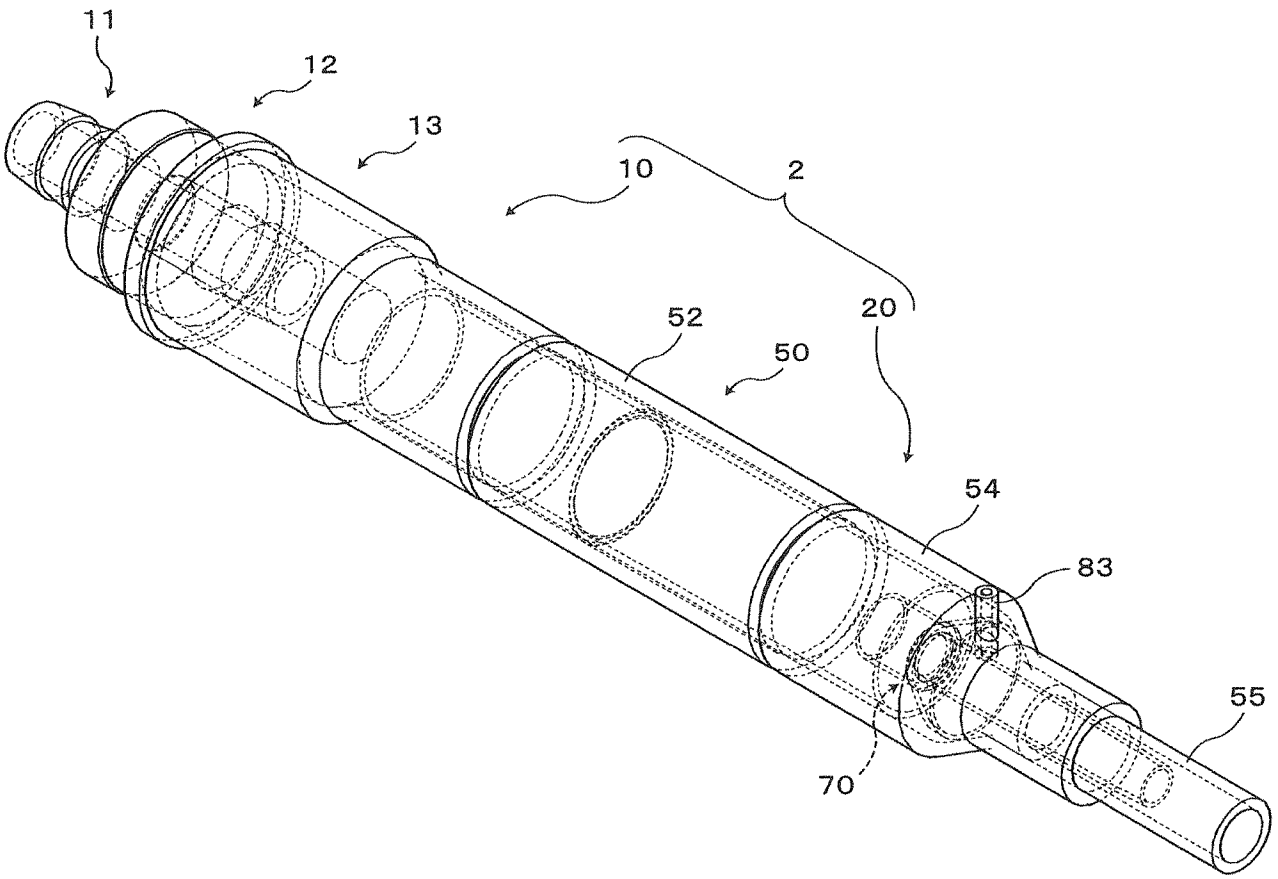
FIG. 2 is a perspective explanatory view of a super-micro bubble generator according to the first embodiment.
Figure 3:
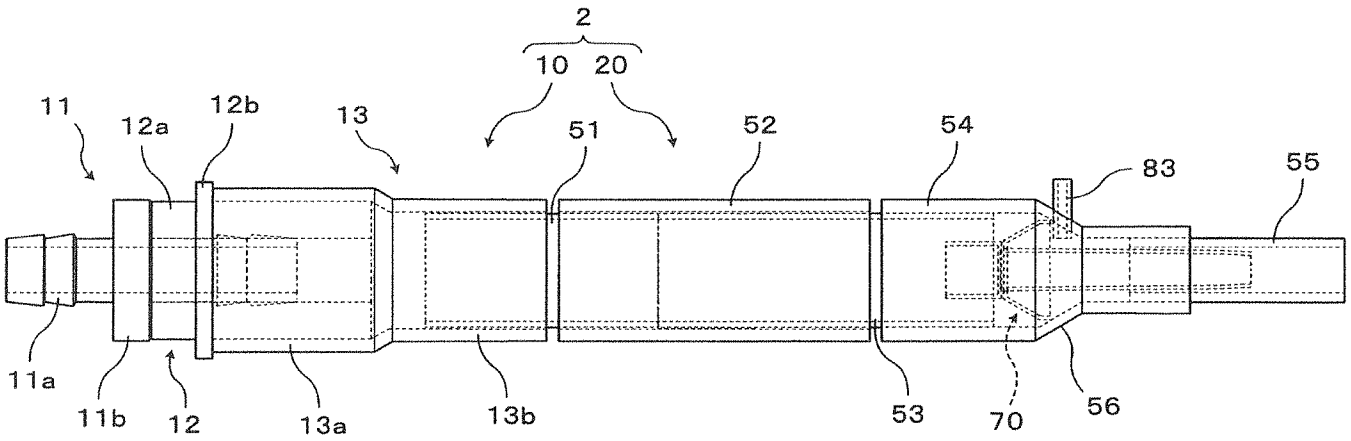
FIG. 3 is a front explanatory view of the super-micro bubble generator according to the first embodiment.
Figure 4:
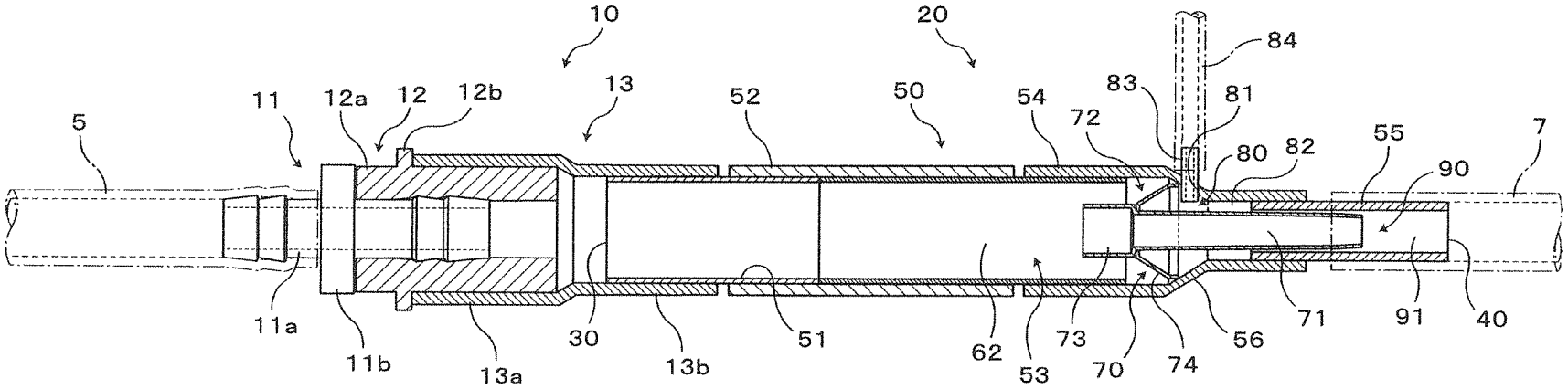
FIG. 4 is a cross-sectional front explanatory view of the super-micro bubble generator according to the first embodiment.

In the super-micro bubble generator 2 according to the first embodiment, as shown in FIG. 2 to FIG. 4, a connecting body 10 and a bubble generator body 20 are arranged linearly on the same axis and are communicably connected to each other.

The connecting body 10 is provided for connecting the bubble generator body 20 to the first communication pipe 5 in a communicable state. That is, the connecting body 10 is constituted of a first connecting member 11, a second connecting member 12, and a third connecting member 13.

The first connecting member 11 is formed using a synthetic resin as an integral body constituted of a cylindrical first connecting body member 11*a* and a first engaging flange member 11*b* which is formed on a middle portion of an outer peripheral surface of the first connecting body member 11*a* in an outwardly projecting manner in a flange shape. A proximal end portion of the first connecting body member 11*a* is connectable to a distal end portion of the first communication pipe 5 formed of a flexible resin by being detachably fitted in the distal end portion of the first communication pipe 5. The first connecting member 11 is engaged with a second connecting body member 12*a* described later in a state where the first engaging flange member 11*b* is brought into contact with a proximal-end-side end surface of the second connecting body member 12*a*.

The second connecting member 12 is formed using an elastic rubber material as an integral body constituted of a second connecting body member 12*a* which is formed in a cylindrical shape, and a second engaging flange member 12*b* which is formed on a proximal end portion of an outer peripheral surface of the second connecting body member 12*a* in an outwardly projecting manner in a flange shape. A distal end portion of the first connecting body member 11*a* is connectable to the second connecting body member 12*a* by being detachably fitted in the second connecting body member 12*a*. The second connecting member 12 is engaged with a third connecting body member 13*a* described later in a state where the second engaging flange member 12*b* is brought into contact with an end surface of a proximal-end-portion-side half portion 13*a* of the third connecting body member 13*a*.

The third connecting member 13 is formed in a cylindrical shape using a synthetic resin. An inner diameter of the proximal-end-portion-side half portion 13*a* is set substantially equal to an outer diameter of the second connecting body member 12*a*, while a diameter of a distal-end-portion-side half portion 13*b* is set slightly smaller than the diameter of the proximal-end-portion-side half portion 13*a*. A distal end portion of the second connecting body member 12*a* is connectable to the proximal-end-portion-side half portion 13*a* by being detachably fitted in the proximal-end-portion-side half portion 13*a*. A first division member 51 of the bubble generator body 20 described later is connectable to the distal-end-portion-side half portion 13*b* by being detachably fitted in the distal-end-portion-side half portion 13*b*.

As shown in FIG. 2 to FIG. 7, the bubble generator body 20 includes, in the inside of a linear cylindrical casing body 50 which has an introduction opening 30 for introducing the liquid F1 on one end thereof and has a delivery opening 40 for delivering the mixed fluid F3 on the other end thereof, a flow speed increasing part 70, a gas suction part 80, and a super-micro bubble containing liquid producing part 90 in the order from the introduction opening 30 to the delivery opening 40.

The flow speed increasing part 70 increases a flow speed of a liquid which is introduced into the casing body 50, has the smaller flow path cross section than the flow path cross section of the casing body 50, and includes a flow speed increasing flow path 71 which extends coaxially with an axis of the casing body 50.

The gas suction part 80 is configured to suck the gas F2 from the outside into the casing body 50 whose inner pressure is lowered (a vacuum pressure being generated with respect to an atmospheric pressure) by a liquid flow whose flow speed is increased by the flow speed increasing part 70 through Venturi effect. The gas suction part 80 includes a gas suction opening 81 which is formed in a middle portion of a peripheral wall of the casing body 50, and a gas suction flow path 82 which has a proximal end portion thereof communicably connected to the suction opening 81 and extends concentrically with an outer periphery of the flow speed increasing flow path 71. A suction amount of the gas F2 can be set to 2% to 4% of a flow rate of the liquid F1 which flows in the first communication pipe 5, and more preferably be set to approximately 3% (STP; 0° C., 1 atmospheric pressure) of the flow rate of the liquid F1. Symbol 83 indicates a gas suction connecting pipe which is communicably connected to and is mounted on the gas suction opening 81 in an erected manner, and symbol 84 indicates a gas suction pipe which is connected to an upper end portion of the gas suction connecting pipe 83, and air which is outside air can be sucked from an upper end opening portion of the gas suction pipe 84. Further, by mounting a flow speed regulation valve (not shown in the drawing) on the gas suction pipe 84, a suction amount of the gas F2 can be changed.

In the super-micro bubble containing liquid producing part 90, the gas F2 which is sucked by the gas suction part 80 is sheared by a liquid flow whose flow speed is increased by the flow speed increasing part 70 so that a liquid into which super-micro bubbles are mixed, that is, the mixed fluid F3 is produced. The super-micro bubble containing liquid producing part 90 includes the super-micro bubble containing liquid producing flow path 91 where a distal end portion of the gas suction flow path 82 and a distal end portion of the flow speed increasing flow path 71 are communicated with each other, and the super-micro bubble containing liquid producing flow path 91 extends toward the delivery opening 40.

The casing 50 includes: a cylindrical first division member 51; a cylindrical second division member 52 which is fitted on a distal end portion of an outer peripheral surface of the first division member 51; a cylindrical third division member 53 which is fitted in a distal end portion of an inner peripheral surface of the second division member 52; a cylindrical fourth division member 54 which is fitted on a distal end portion of an outer peripheral surface of the third division member 53; and a cylindrical fifth division member 55 which is fitted in a distal end portion of an inner peripheral surface of the fourth division member 54. Further, the fourth division member 54 is formed such that a diameter of the fourth division member 54 on a distal end portion side is set smaller than a diameter of the fourth division member 54 on a proximal end portion side with a diameter decreasing portion 56 formed on a middle portion of the fourth division member 54 sandwiched between the distal end portion side and the proximal end portion side.

Figure 5:
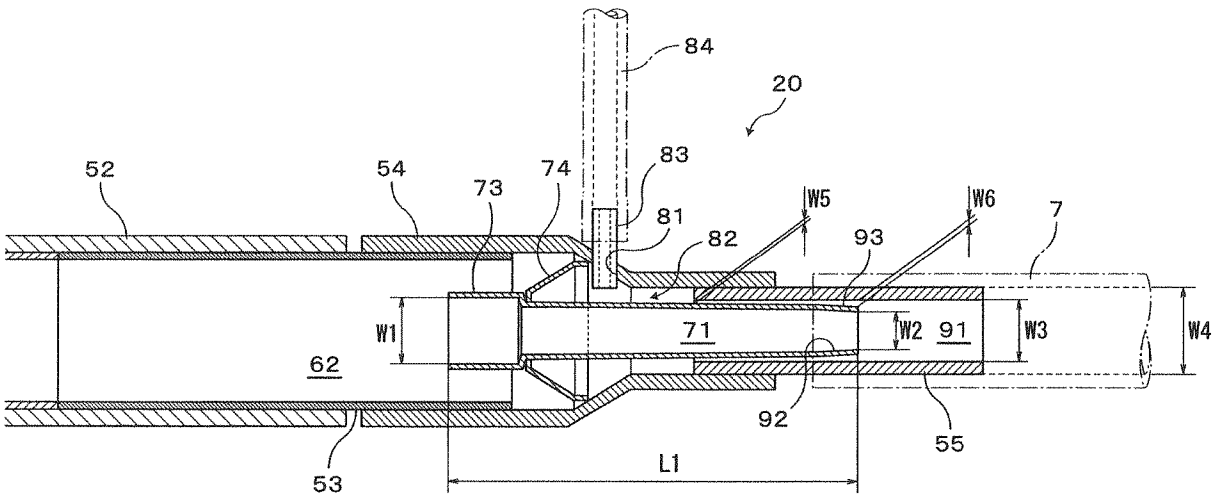
FIG. 5 is an enlarged cross-sectional front explanatory view of the super-micro bubble generator according to the first embodiment.

As shown in FIG. 5, the flow speed increasing flow path 71 is formed such that a speed increasing flow path forming body 72 is arranged in the fourth division member 54. That is, the speed increasing flow path forming body 72 includes: a cylindrical flow path forming member 73 whose outer diameter is set smaller than an inner diameter of the fourth division member 54 on a distal end portion side; and an umbrella-shaped support member 74 which is formed in a projecting manner toward a downstream side from a proximal end portion of an outer peripheral surface of the flow path forming member 73. A distal-end peripheral portion of the umbrella-shaped support member 74 is brought into contact with the diameter decreasing portion 56 of the fourth division member 54, and a distal end portion of the flow path forming member 73 is concentrically arranged in the distal end portion of the fourth division member 54. The distal end portion of the flow path forming member 73 has a diameter thereof gradually decreased from an upstream side toward a downstream side thus forming an inner peripheral tapered surface 92 and an outer peripheral tapered surface 93. In FIG. 5, symbol L1 indicates a longitudinal width (cylinder length) of the flow path forming member 73, symbol W1 indicates an inner diameter of a proximal end opening portion of the flow path forming member 73, symbol W2 indicates an inner diameter of a distal end opening portion of the flow path forming member 73, symbol W3 indicates an inner diameter of the fifth division member 55, symbol W4 indicates an outer diameter of the fifth division member 55, symbol W5 indicates a minimum gap formed between the outer peripheral surface of the flow path forming member 73 and the inner peripheral surface of the fifth division member 55, and symbol W6 indicates a maximum gap formed between the outer peripheral tapered surface 93 of the flow path forming member 73 and the inner peripheral surface of the fifth division member 55.

Due to such a constitution, a liquid flow which flows inside the distal end portion of the flow path forming member 73 flows along the inner peripheral tapered surface 92 while increasing a flow speed thereof. On the other hand, a gas flow which flows outside the distal end portion of the flow path forming member 73 flows along the outer peripheral tapered surface 93 in such a manner that a flow rate is increased while a flow speed is decreased. Accordingly, when the liquid flow whose flow speed is increased and the gas flow whose flow rate is increased are merged together, the liquid flow imparts a large shearing force to the gas flow so that a large amount of super-micro homogenized bubbles can be produced. That is, by adjusting a taper angle of the inner peripheral tapered surface 92 and a taper angle of the outer peripheral tapered surface 93, a size and an amount of bubbles can be controlled.

The gas suction flow path 82 is constituted of a gap formed between the outer peripheral surface of the flow path forming member 73 and the inner peripheral surface of the distal end portion of the fourth division member 54, and a gap formed between the outer peripheral surface of the flow path forming member 73 and the inner peripheral surface of the distal end portion of the fifth division member 55. The gas suction flow path 82 is formed in a cylindrical shape on an outer periphery of a distal end portion side of the flow speed increasing flow path 71.

Figure 6:
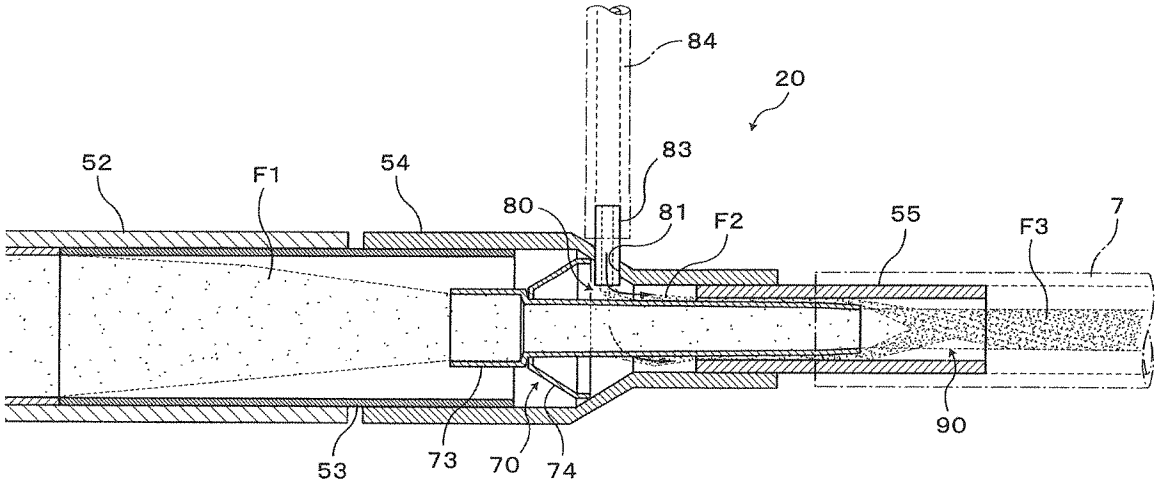
FIG. 6 is an enlarged cross-sectional front explanatory view of a flow state in the super-micro bubble generator according to the first embodiment.
Figure 7:
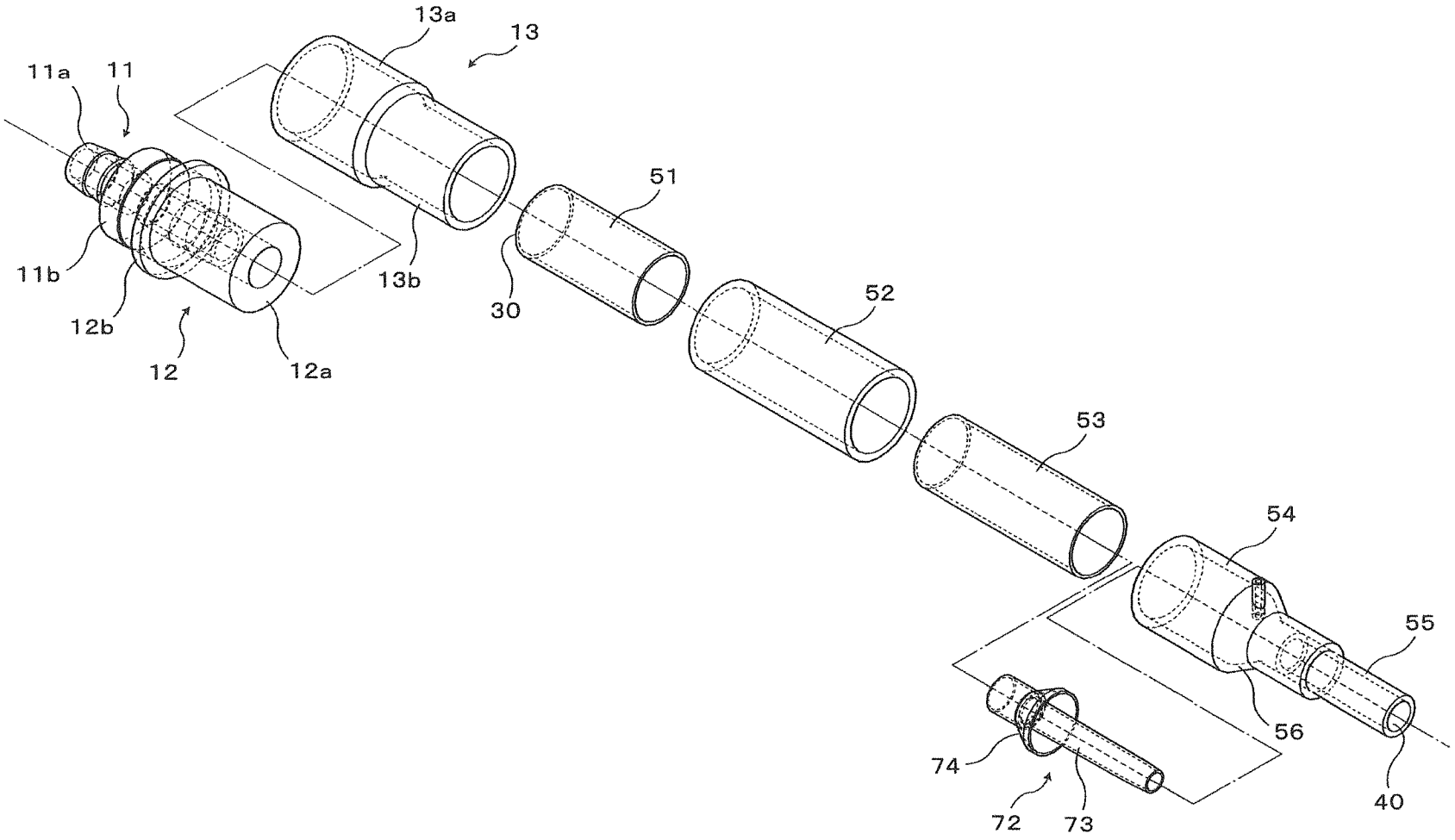
FIG. 7 is a perspective exploded explanatory view of the super-micro bubble generator according to the first embodiment.

In the first embodiment having the above-mentioned constitution can acquire the following manner of operation and advantageous effects. That is, as shown in FIG. 4 and FIG. 6, in the super-micro bubble generator 2, a speed of the liquid F1 which is introduced from the introduction opening 30 is increased by the flow speed increasing part 70. That is, the flow speed increasing flow path 71 which the flow speed increasing part 70 includes has a small flow path cross section which is approximately one fourth of a flow path cross section of the swirl flow guiding flow path 62 and extends coaxially with an axis of the casing body 50. Accordingly, a flow speed of the liquid flow of the liquid F1 can be surely increased. Here, a flow speed of the liquid flow can be adjusted by suitably adjusting the flow path cross section of the flow speed increasing flow path 71. Accordingly, even when the liquid F1 is introduced with a slow flow speed, the flow speed of the liquid flow can be suitably increased so that the desired mixed liquid F3 can be produced.

Due to the liquid flow whose flow speed is increased by the flow speed increasing part 70, a pressure in the flow speed increasing part 70 in the casing body 50 is lowered. Accordingly, the gas suction part 80 sucks the gas F2 which is outside air from the outside through the gas suction opening 81 through Venturi effect, and allows the gas F2 to flow into the outer periphery of the flow speed increasing flow path 71 concentrically through the gas suction flow path 82.

Then, in the super-micro bubble containing liquid producing part 90, the gas F2 which is sucked by the gas suction part 80 is sheared by the liquid flow whose flow speed is increased by the flow speed increasing part 70 so that a liquid into which super-micro bubbles are mixed is produced. That is, in the super-micro bubble containing liquid producing flow path 91, the outer periphery of the liquid F1 which forms the liquid flow whose flow speed is increased is cylindrically surrounded by the sucked gas. Then, the outer peripheral portion of the liquid flow whose flow speed is increased imparts a high shearing force to the cylindrical gas F2 which surrounds the outer periphery of the liquid F1 in such a manner that the outer peripheral portion of the liquid flow pulls and slides the cylindrical gas F2 from the inside. That is, not at the center side of the swirl flow but at the outer peripheral side of the swirl flow where a swirl strength is relatively strong compared to the center side, a high shearing force can be applied to the whole inner peripheral surface of the cylindrical gas F2 which surrounds the outer periphery of the swirl flow. Accordingly, in the super-micro bubble-containing liquid producing flow path 91, the sucked gas F2 can be efficiently made fine and homogenized at a super micro level. As a result, in the super-micro bubble-containing liquid producing flow path 91, a liquid containing homogenized super-micro bubbles (mixed fluid F3) can be surely produced, and the mixed fluid F3 is delivered from the delivery opening 40.

The casing body 50 is formed by connecting the cylindrical first to fifth division members 51 to 55 by fitting engagement, and the fourth division member 54 is formed such that a diameter of the fourth division member 54 on a distal end portion side is set smaller than the diameter of the fourth division member 54 on a proximal end portion side with a diameter decreasing portion 56 formed on the middle portion of the fourth divided member 54 interposed between the distal end portion side and the proximal end portion side.

In the flow speed increasing flow path 71, the distal-end peripheral portion of the umbrella-shaped support member 74 is brought into contact with the diameter decreasing portion 56 of the fourth division member 54, and the distal end portion of the flow path forming member 73 is arranged concentrically in the inside of the distal end portion of the fourth division member 54 so that the gas suction flow path 82 can be cylindrically formed in a gap between the outer peripheral surface of the flow path forming member 73 and the inner peripheral surface of the distal end portion of the fourth division member 54. That is, by merely arranging the speed increasing flow path forming body 72 in the inside of the fourth division member 54, the swirl flow guiding flow path 62, the flow speed increasing flow path 71, the gas suction flow path 82 and the super-micro bubble containing liquid producing flow path 91 can be easily and surely formed in a partitioned manner.

Second Embodiment

Figure 8:
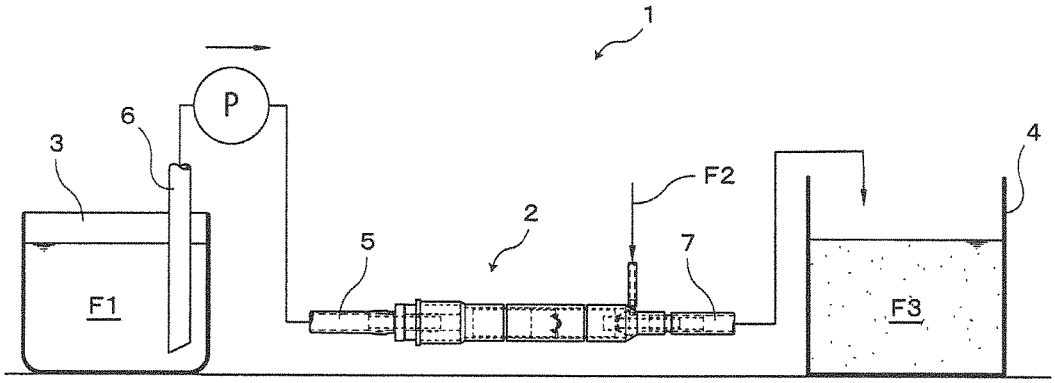
FIG. 8 is an explanatory view of a super-micro bubble generating device according to a second embodiment.
Figure 9:
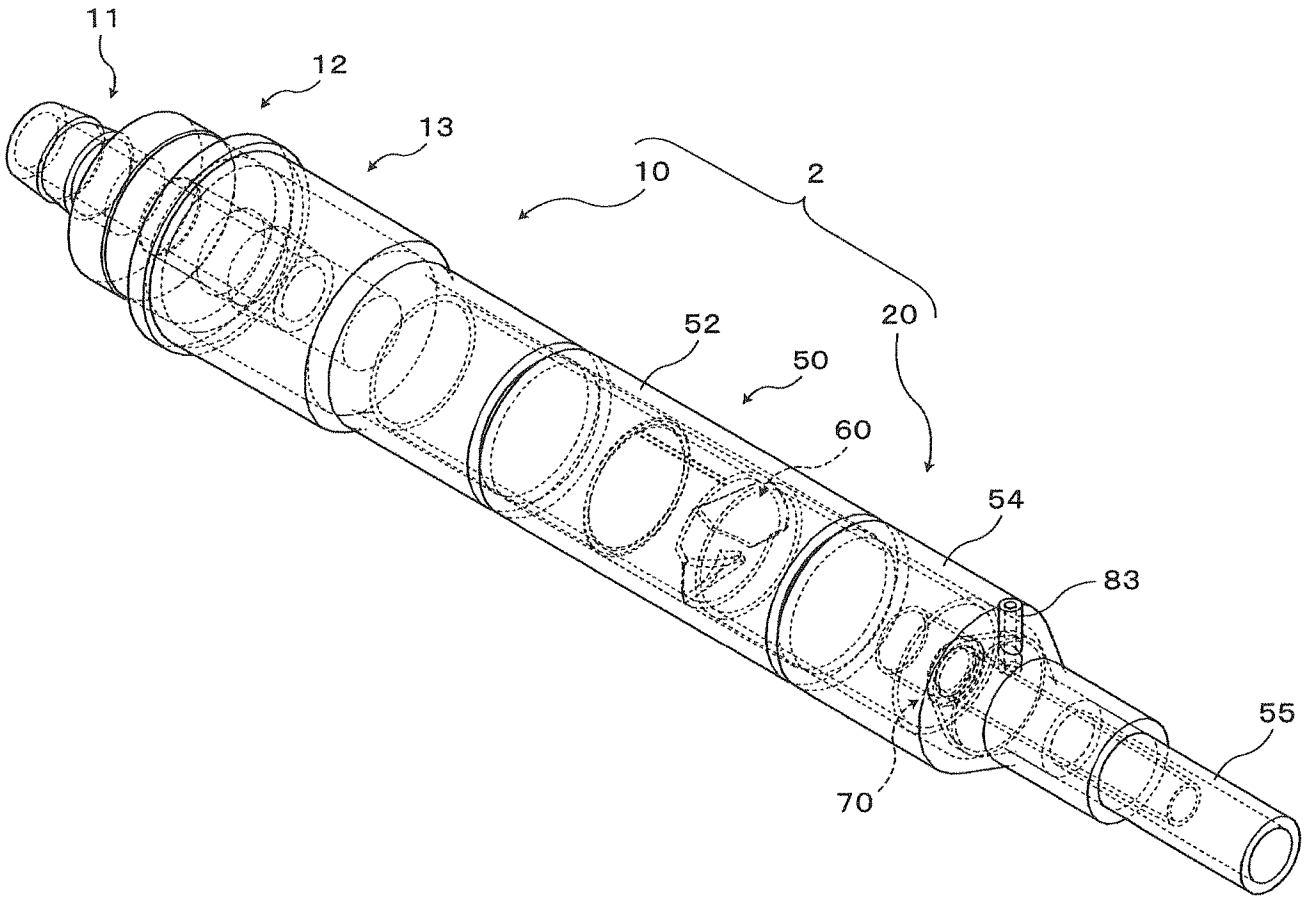
FIG. 9 is a perspective explanatory view of a super-micro bubble generator according to the second embodiment.
Figure 10:
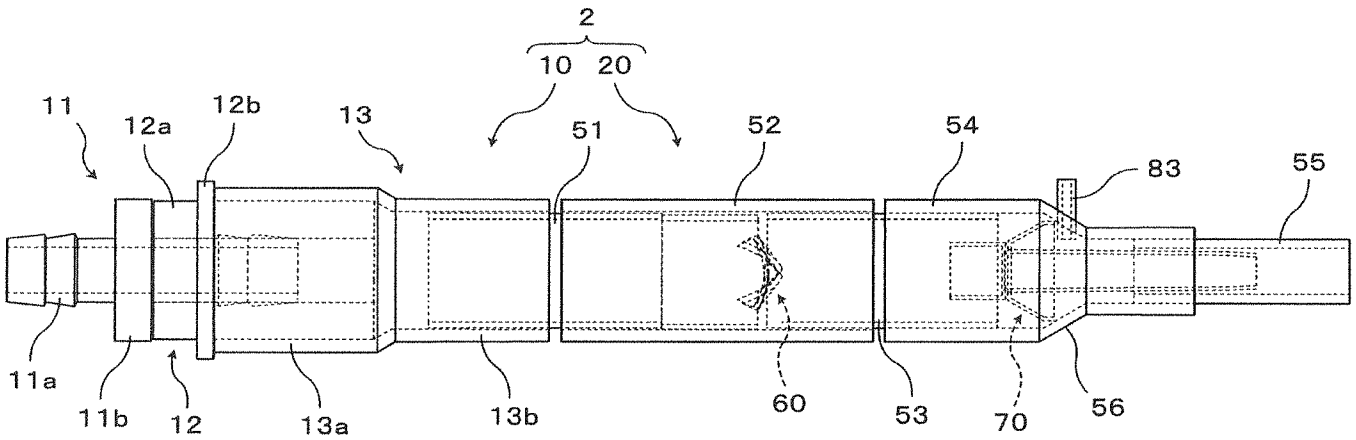
FIG. 10 is a front explanatory view of the super-micro bubble generator according to the second embodiment.

Symbol 1 shown in FIG. 8 indicates a super-micro bubble generating device according to a second embodiment, and the super-micro bubble generating device 1 according to the second embodiment has the same basic structure as the super-micro bubble generating device 1 according to the first embodiment. The super-micro bubble generating device 1 according to the second embodiment differs from the super-micro bubble generating device 1 according to the first embodiment with respect to a point that the super-micro bubble generating device 1 according to the second embodiment adopts a super-micro bubble generator 2 according to the second embodiment in place of the super-micro bubble generator 2 according to the first embodiment.

(Explanation of Super-Micro Bubble Generator 2 According to Second Embodiment)

The super-micro bubble generator 2 according to the second embodiment has, as shown in FIG. 2 to FIG. 4, the same basic structure as the super-micro bubble generator 2 according to the first embodiment. However, the super-micro bubble generator 2 according to the second embodiment differs from the super-micro bubble generator 2 according to the first embodiment with respect to a point that the super-micro bubble generator 2 according to the second embodiment adopts a swirl flow forming part 60.

That is, as shown in FIG. 9 to FIG. 15, the bubble generator body 20 includes the swirl flow forming part 60, a flow speed increasing part 70, a gas suction part 80 and a super-micro bubble containing liquid producing part 90 in the inside of a linear cylindrical casing body 50 which has an introduction opening 30 for introducing a liquid F1 on one end thereof and has a delivery opening 40 for delivering a mixed fluid F3 on the other end thereof, in the order from the introduction opening 30 to the delivery opening 40.

The swirl flow forming part 60 is configured to form a liquid F1 introduced from the introduction opening 30 into a swirl flow. The swirl flow forming part 60 includes: a swirl flow means 61 which forms the liquid F1 passing through the swirl flow means 61 into a swirl flow; and a swirl flow guiding flow path 62 which extends along an axis of the casing body 50 on a downstream side of the swirl flow means 61. The swirl flow guiding flow path 62 is formed in a linear shape along an inner peripheral surface of the third division member 53 which forms a portion of the casing body 50.

As also shown in FIG. 6, the swirl flow means 61 includes: an approximately cylindrical support member 63 which is fitted on a middle portion of an inner peripheral surface of a second division member 52, and a pair of swirl flow forming members 64, 64 which is formed in a projecting manner in the direction toward an axis from a distal-end edge portion of the support member 63 such that the swirl flow forming members 64, 64 opposedly face each other in a twisted manner. The support member 63 is positioned by being sandwiched between a first division member 51 and a third division member 53 in the axial direction in the inside of the second division member 52. The liquid F1 is formed into a swirl flow by receiving a twisting action from the swirl flow forming members 64, 64 when the liquid F1 passes between the pair of swirl flow forming members 64, 64 which opposedly faces each other in a twisted manner. Then, the swirl flow passes through the swirl flow guiding flow path 62 and is guided to the flow speed increasing part 70 downstream of the swirl flow guiding flow path 62.

Figure 11:
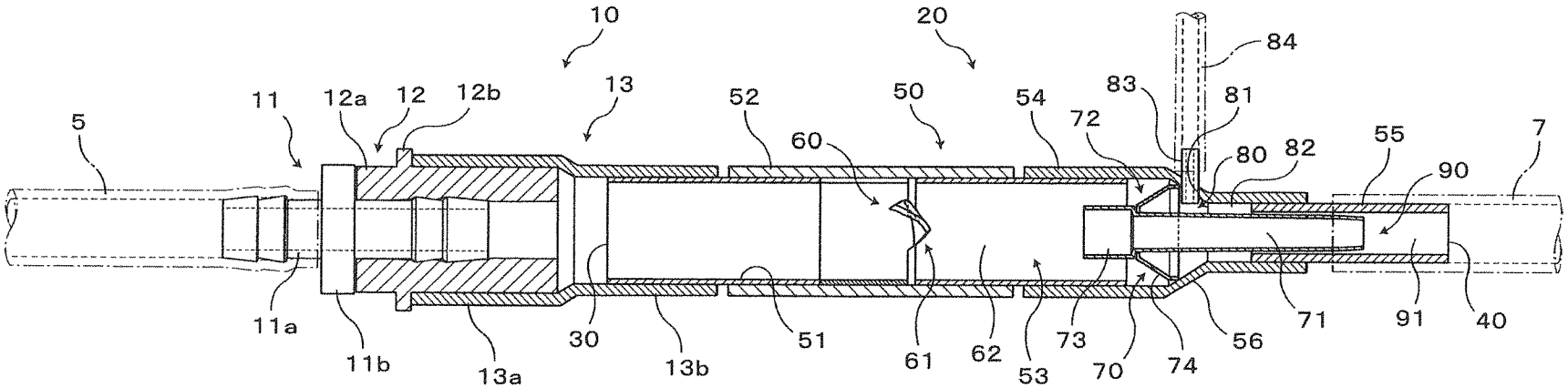
FIG. 11 is a cross-sectional front explanatory view of the super-micro bubble generator according to the second embodiment.
Figure 12:
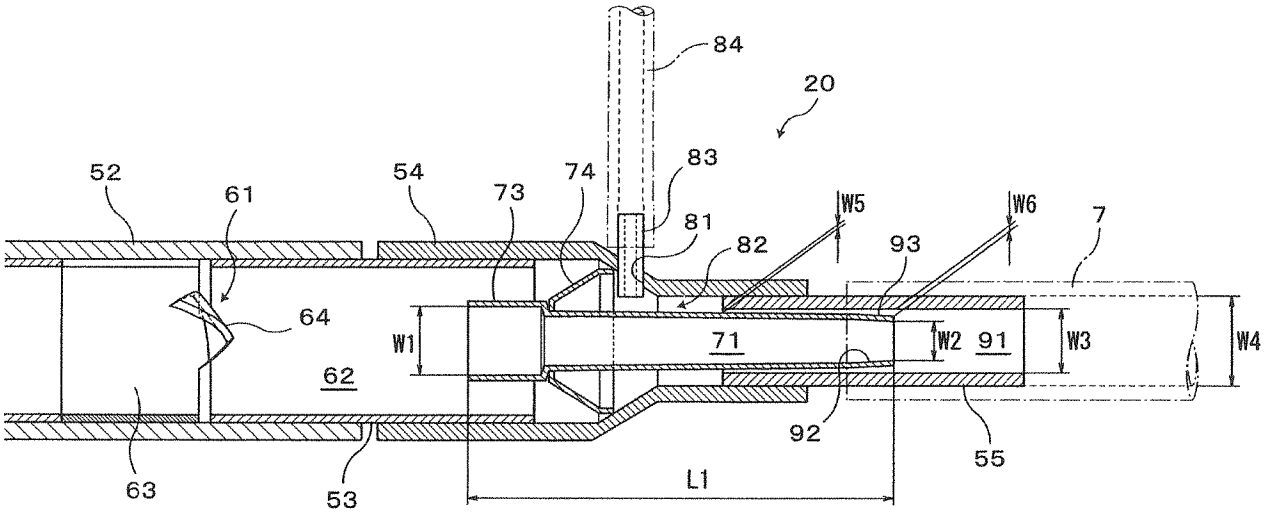
FIG. 12 is an enlarged cross-sectional front explanatory view of the super-micro bubble generator according to the second embodiment.
Figure 13:
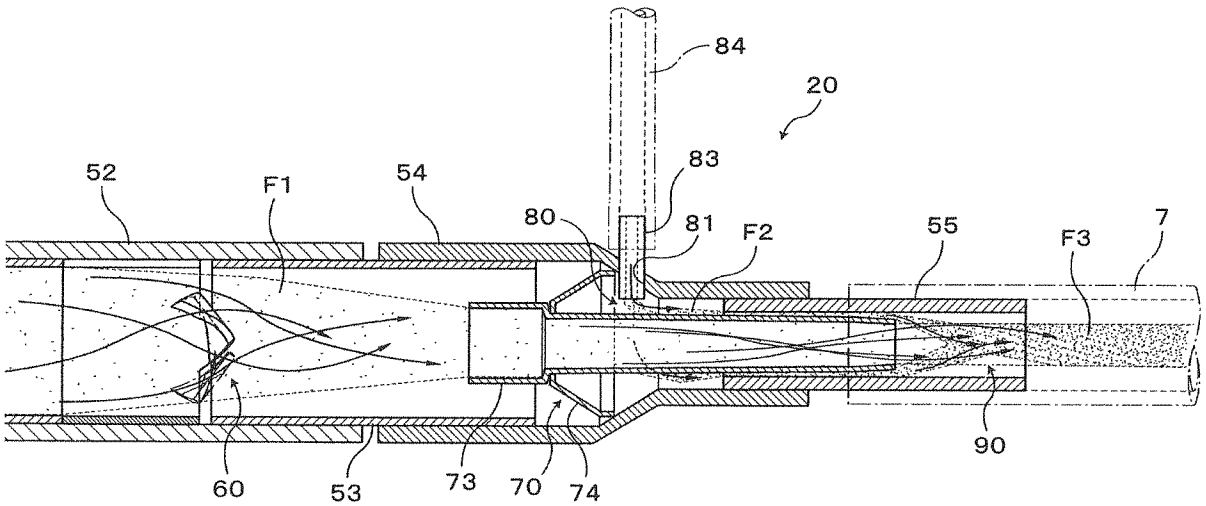
FIG. 13 is an enlarged cross-sectional front explanatory view of a flow state in the super-micro bubble generator according to the second embodiment.
Figure 15:
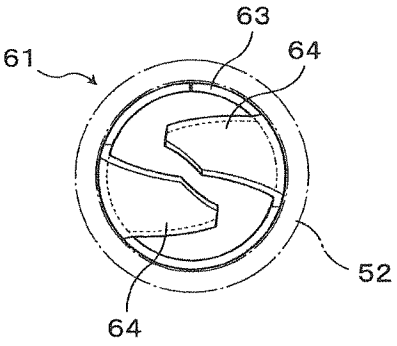
FIG. 15 is an explanatory side view of a swirl flow means.
Figure 14:
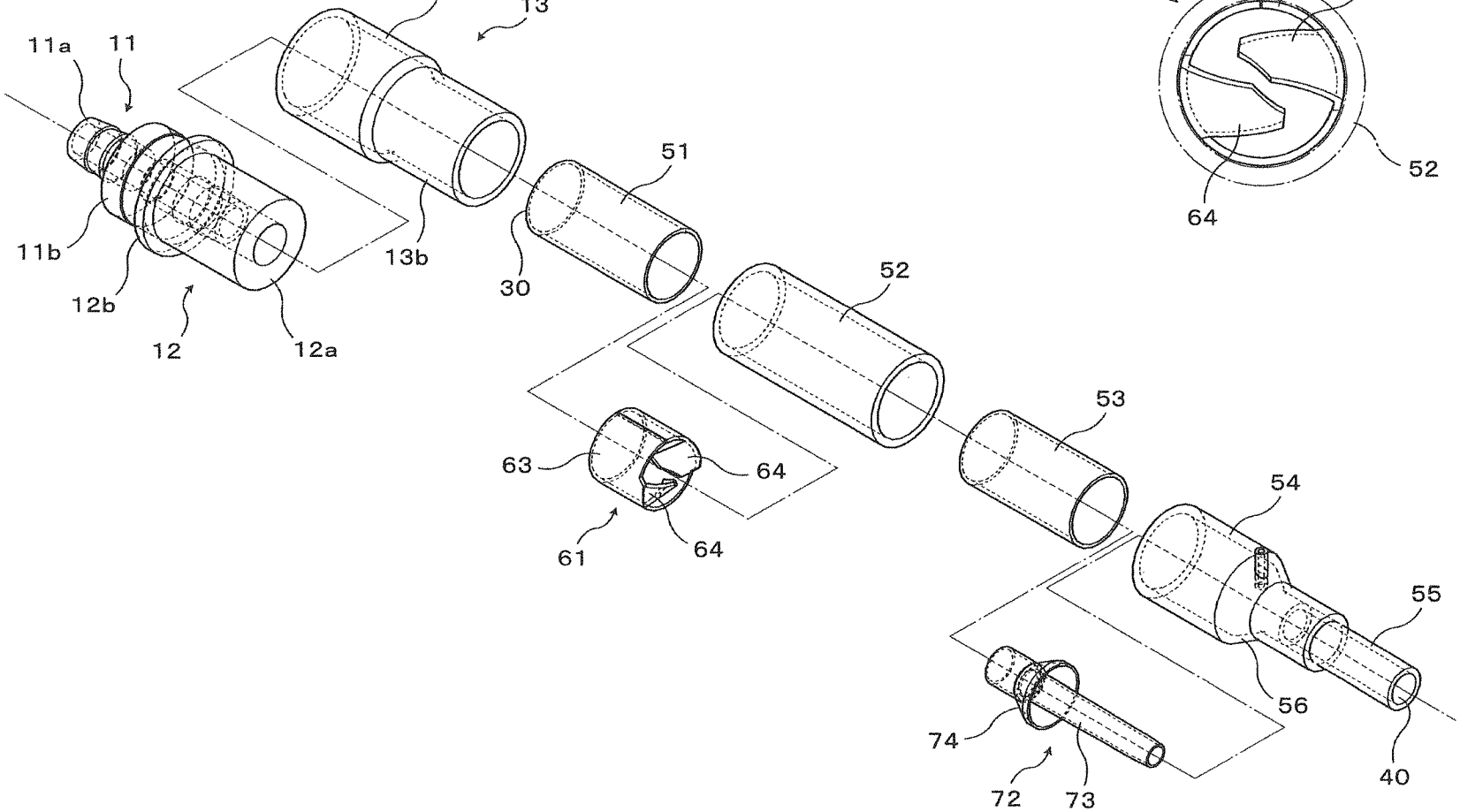
FIG. 14 is a perspective exploded explanatory view of the super-micro bubble generator according to the second embodiment.

The second embodiment having the above-mentioned constitution can acquire the following advantageous effects. That is, as shown in FIG. 11 and FIG. 13, in the super-micro bubble generator 2, the fluid F1 introduced from the introduction opening 30 can be formed into a swirl flow by the swirl flow forming part 60. The swirl flow means 61 of the swirl flow forming part 60 forms the liquid F1 which passes through the swirl means 61 of the swirl flow forming part 60 into a swirl flow, and the swirl flow guiding flow path 62 which extends along the axis of the casing body 50 on a downstream side of the swirl flow means 61 guides the swirl flow to a downstream side.

A flow speed of the swirl flow which is formed by the swirl flow forming part 60 is increased by the flow speed increasing part 70. That is, the flow speed increasing flow path 71 which the flow speed increasing part 70 includes has a small flow path cross section which is approximately one fourth of a flow path cross section of the swirl flow guiding flow path 62, and extends coaxially with the axis of the casing body 50 and hence, the flow speed increasing flow path 71 can surely increase a flow speed of the swirl flow. Here, the adjustment of the flow speed of the swirl flow can be performed by suitably adjusting the flow path cross section of the flow speed increasing flow path 71. Accordingly, even when a liquid flow is formed of a liquid F1 which is introduced with a slow speed, the liquid flow can be formed into a swirl flow and, further, a flow speed of the swirl flow can be suitably increased.

Due to the swirl flow whose flow speed is increased by the flow speed increasing part 70, a pressure in the flow speed increasing part 70 in the casing body 50 is lowered. Accordingly, the gas suction part 80 sucks the gas F2 which is outside air from the outside through the gas suction opening 81 through Venturi effect, and allows the gas F2 to flow into the outer periphery of the flow speed increasing flow path 71 concentrically through the gas suction flow path 82.

Then, in the super-micro bubble containing liquid producing part 90, the gas F2 which is sucked by the gas suction part 80 is sheared by the swirl flow whose flow speed is increased by the flow speed increasing part 70 so that a liquid into which super-micro bubbles are mixed is produced. That is, in the super-micro bubble containing liquid producing flow path 91, the outer periphery of the liquid F1 which forms the swirl flow whose flow speed is increased is cylindrically surrounded by the sucked gas. Then, the outer peripheral portion of the swirl flow which has strong swirl strength imparts a high shearing force to the cylindrical gas F2 which surrounds the outer periphery of the liquid F1 from the inside. That is, not at the center side of the swirl flow but at the outer peripheral side of the swirl flow where swirl strength is relatively strong compared to the center side, a high shearing force can be applied to the whole inner peripheral surface of the cylindrical gas F2 which surrounds the outer periphery of the swirl flow. Accordingly, in the super-micro bubble-containing liquid producing flow path 91, the sucked gas F2 can be efficiently made super-fine and homogenized at a super micro level. As a result, in the super-micro bubble-containing liquid producing flow path 91, a liquid containing homogenized super-micro bubbles (mixed fluid F3) can be surely generated, and the mixed fluid F3 is delivered from the delivery opening 40.

The cylindrical support member 63 which the swirl flow means 61 includes can be easily positioned by fitting the support member 63 on the middle portion of the inner peripheral surface of the second division member 52, and by sandwiching the support member 63 between the first division member 51 and the third division member 53 in the axial direction in the inside of the second division member 52. That is, an assembling operation of the swirl flow means 61 (in a case where the super-micro bubble generator 2 according to the second embodiment is adopted) and a removing operation of the swirl flow means 61 (in the case where the super-micro bubble generator 2 according to the first embodiment is adopted) can be easily and surely performed.

(Explanation of Swirl Flow Means 61 According to First Modification)

Figure 16:
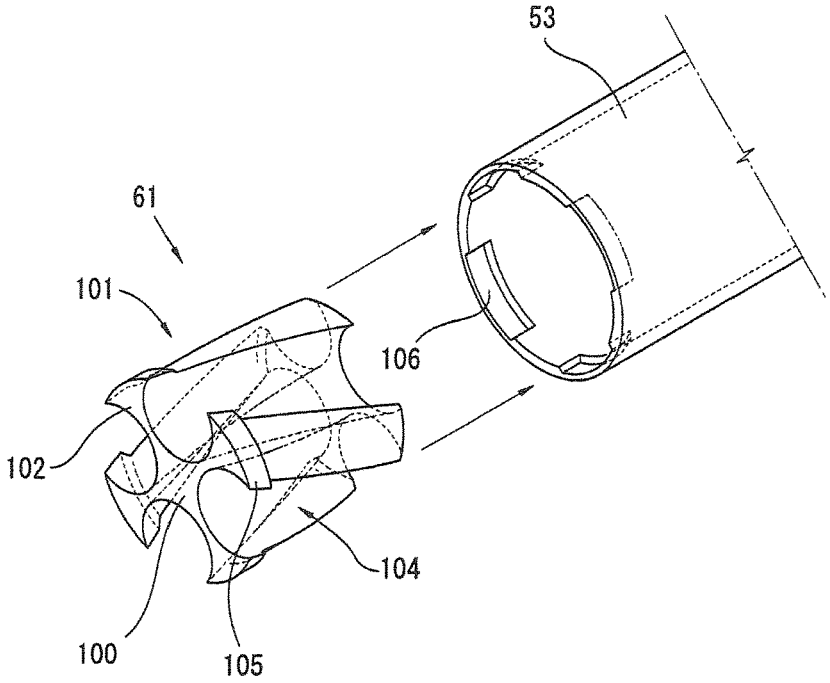
FIG. 16 is a perspective explanatory view for explaining mounting of a swirl flow means according to a first modification.
Figure 17:
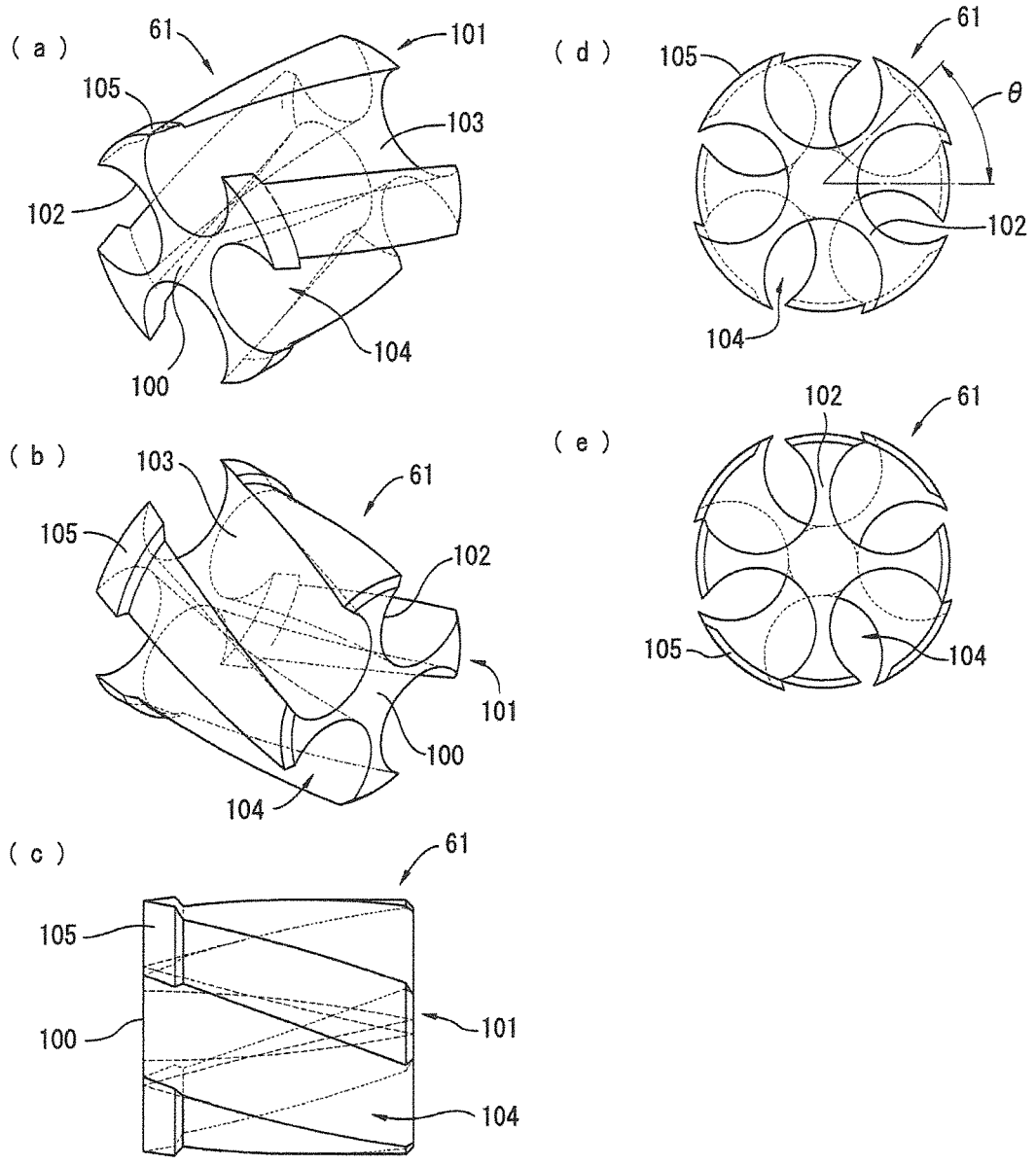
FIG. 17(*a*) to FIG. 17(*e*) are views showing the swirl flow means according to the first modification, wherein FIG. 17(*a*) is a perspective view of an upstream side of the swirl flow means, FIG. 17(*b*) is a perspective view of a downstream side of the swirl flow means, FIG. 17(*c*) is a front view of the swirl flow means, FIG. 17(*d*) is a side view of the upstream side of the swirl flow means, and FIG. 17(*e*) is a side view of the downstream side of the swirl flow means.

FIG. 16 shows a swirl flow means 61 which constitutes the first modification. As also shown in FIG. 17, the swirl flow means 61 is manufactured by forming a rod-shaped core portion 100 extending straightly and a plurality of (four in this embodiment) plate-shaped swirl flow forming guide members 101 formed on a peripheral surface of the core portion 100 in a projecting manner in the radial direction by cutting a synthetic resin (for example, polybutylene-terephthalate (PBT)) such that the swirl flow means 61 has a smooth surface (for decreasing a friction between the swirl flow means 61 and water which constitutes the liquid F1). That is, the swirl flow means 61 is formed into a cruciform cross section by extending four guide body members 102 having a thick-wall plate shape from a peripheral surface of the rod-shaped core portion 100 at equal intervals, an arcuate recessed surface 103 is formed on both side surfaces of each guide body member 102 ranging from a proximal end portion to a distal end portion, and proximal end edge portions of the arcuate recessed surfaces 103 of the neighboring guide body members 102 form a continuous arcuate surface. Each guide body member 102 is formed such that a middle portion of the guide body member 102 has the minimum thickness and the distal end portion of the guide body member 102 has the maximum thickness.

Further, an upstream side end surface and a downstream side end surface of the swirl flow means 61 are arranged at positions where the extending direction of the swirl flow forming guide members 101 from an upstream side to a down stream side is twisted from the axial direction of the core portion 100 such that a predetermined twisting angle θ (for example, θ=45° to 60°) is formed. Four swirl flow forming guide members 101 which are arranged at positions twisted from the axial direction of the core portion 100 are arranged substantially parallel to each other, and four twisted swirl flow forming guide paths 104 are formed about an axis of the core portion 100 between the neighboring swirl flow forming guide members 101.

A projection portion 105 for engagement positioning is formed on an upstream side portion of a distal end portion of each guide body member 102. Four engaging recessed portions 106 which are engageable with the projection portions 105 are formed circumferentially on an upstream side end portion of an inner peripheral surface of the third division member 53 in a state where the engaging recessed portion 106 is aligned with the projection portion 105. The upstream side end portion of the third division member 53 is formed in an extending manner toward the first division member 51 side, and an upstream side end surface of the third division member 53 and a downstream side end surface of the first division member 51 are brought into contact with each other in the inside of the second division member 52.

After assembling the swirl flow means 61 as described above, the swirl flow means 61 is inserted into the third division member 53 from an upstream side to a downstream side, the projection portions 105 are inserted into and engaged with the respective engaging recessed portions 106, and the upstream side end surface of the third division member 53 and the downstream side end surface of the first division member 51 are brought into contact with each other in the inside of the second division member 52 in such an engagement state. Accordingly, it is possible to suppress the swirl flow means 61 from moving in the axial direction and circumferentially on the peripheral surface. In such a state, the distal end surface of the swirl flow forming guide member 101 is brought into close face contact with an inner peripheral surface of the third division member 53. Accordingly, a liquid flow which flows into the third division member 53 is made to flow from an upstream side to a downstream side along the swirl flow forming guide paths 104 arranged in the inside of the third division member 53 and hence, a swirl flow can be surely formed.

(Explanation of Swirl Flow Means 61 which Constitutes Second Modification)

Figure 18:
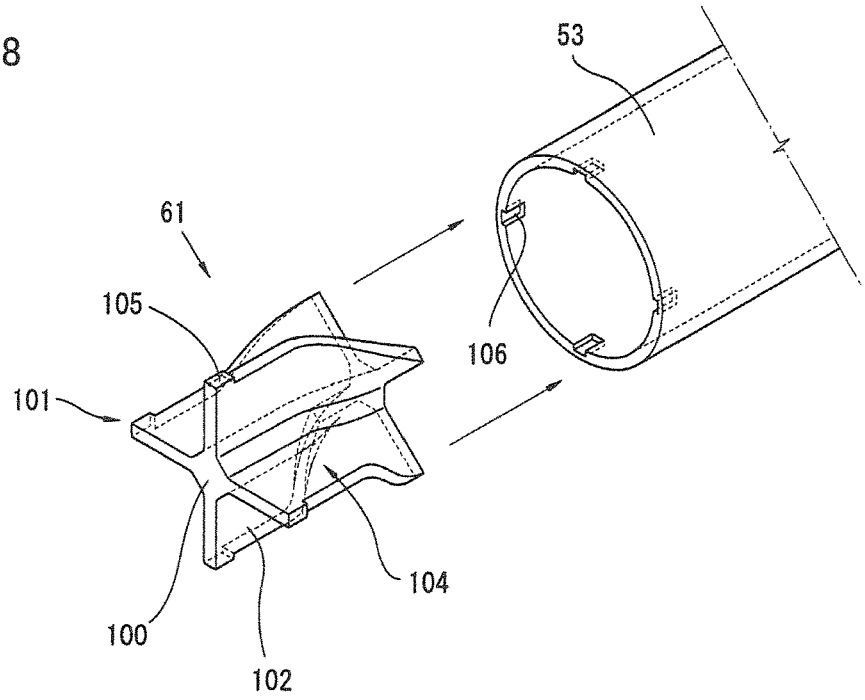
FIG. 18 is a perspective explanatory view for explaining mounting of a swirl flow means according to a second modification.
Figure 19:
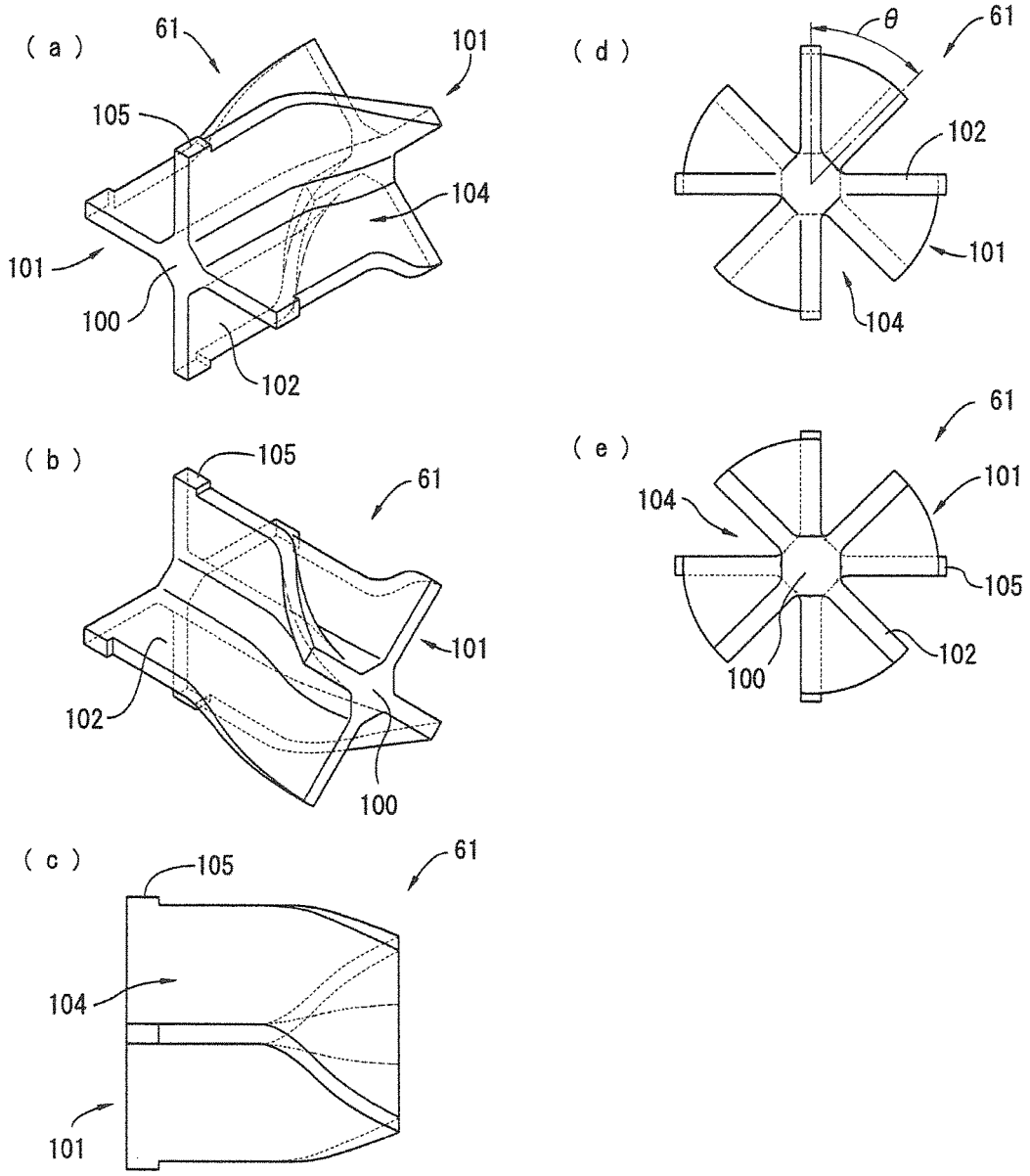
FIG. 19(*a*) to FIG. 19(*e*) are views showing the swirl flow means according to the second modification, wherein FIG. 19(*a*) is a perspective view of an upstream side of the swirl flow means, FIG. 19(*b*) is a perspective view of a downstream side of the swirl flow means, FIG. 19(*c*) is a front view of the swirl flow means, FIG. 19(*d*) is a side view of the upstream side of the swirl flow means, and FIG. 19(*e*) is a side view of the downstream side of the swirl flow means.

FIG. 18 shows the swirl flow means 61 which constitutes the second modification. As also shown in FIG. 19, the swirl flow means 61 is manufactured by integrally laminating a rod-shaped core portion 100 extending straightly, and a plurality of (four in this embodiment) plate-shaped swirl flow forming guide members 101 formed on a peripheral surface of the core portion 100 in a projecting manner in the radial direction using a synthetic resin (for example, an ABS resin). That is, the swirl flow means 61 is formed into a cruciform cross section by extending four guide body members 102 having a quadrangular plate shape with a uniform wall thickness from a peripheral surface of the rod-shaped core portion 100 having a regular octagonal cross section in a state where each guide body member 102 extends from every one other side of the core portion 100.

Further, an upstream side end surface and a downstream side end surface of the swirl flow means 61 are arranged so as to form a predetermined twisting angle θ (for example, θ=45° to 60°), an upstream half portion of the guide body member 102 has the extending direction thereof toward a downstream side form an upstream side arranged parallel to the axial direction of the core portion 100, and a downstream half portion of the guide body member 102 has the extending direction thereof toward a downstream side form an upstream side arranged at a position twisted from the axial direction of the core portion 100. That is, four swirl flow forming guide members 101 which are arranged at positions twisted from the axial direction of the core portion 100 are formed by being bent in an L shape such that the upstream half portion of the guide body members 102 are arranged substantially parallel to the axis of the core portion 110 and the downstream half portions of the guide body members 102 are arranged substantially parallel to each other in a twisted manner about the axis of the core portion 100 thus forming four swirl flow forming guide paths 104 between the neighboring swirl flow forming guide members 101 in a state where a middle portion of the guide body member 102 is bent.

A projection portion 106 for engagement positioning is formed on an upstream side portion of a distal end portion of each guide body member 102. Four engaging recessed portions 106 with which the projection portions 105 are engageable are formed circumferentially on an upstream side end portion of an inner peripheral surface of the second division member 52 in a state where the engaging recessed portion 106 is aligned with the projection portion 105. The upstream side end portion of the third division member 53 is formed in an extending manner toward the first division member 51 side, and an upstream side end surface of the third division member 53 and a downstream side end surface of the first division member 51 are brought into contact with each other in the inside of the second division member 52.

After assembling the swirl flow means 61 as described above, the swirl flow means 61 is inserted into the third division member 53 from an upstream side to a downstream side, the projection portions 105 are inserted into and engaged with the respective engaging recessed portions 106, and the upstream side end surface of the third division member 53 and the downstream side end surface of the first division member 51 are brought into contact with each other in the inside of the second division member 52 in such an engagement state. Accordingly, it is possible to movement of the swirl flow means 61 in the axial direction and circumferentially on the peripheral surface. In such a state, the distal end surface of the swirl flow forming guide member 101 is brought into close face contact with an inner peripheral surface of the third division member 53. Accordingly, a liquid flow which flows into the third division member 53 is made to flow from an upstream side to a downstream side along the swirl flow forming guide paths 104 arranged in the inside of the third division member 53 and hence, a swirl flow can be surely formed.

Although the suction connection pipe 83 according to the first and second embodiments can be connected to a gas source other than an air source, the suction connection pipe 83 can be connected also to a fluid source other than a gas source, for example, to a liquid source. That is, the super-micro bubble generator according to the first and second embodiments is also used as a super-micro liquid droplets generator where the suction connection pipe 83 is connected to a liquid source for forming a dispersion phase while connecting the connection body 10 to a liquid source for forming a continuous phase so that a liquid which constitutes a continuous phase and a liquid which constitutes a dispersion phase are mixed with each other thus forming a liquid-liquid mixed phase, and a dispersed liquid is formed into super-micro and homogenized particles.

Example

First Example

In the first example, an experiment where a mixed fluid F3 is generated using the super-micro bubble generating device 1 according to the second embodiment is carried out. Here, a longitudinal width L1 of the flow path forming member 73 of the used speed increasing flow path forming body 72 is set to 85 mm (L1=85 mm), an inner diameter W1 of a proximal end opening portion of the flow path forming member 73 is set to 14 mm (W1=14 mm), an inner diameter W2 of a distal end opening portion of the flow path forming member 73 is set to 8 mm (W2=8 mm), an inner diameter W3 of a fifth division member 55 is set to 13 mm (W3=13 mm), an outer diameter W4 of the fifth division member 55 is set to 18 mm (W4=18 mm), and a minimum distance W5 is set to 0.8 mm (W5=0.8 mm).

Further, city service water is used as a liquid F1 (continuous phase), and outside air (air) is used as a gas F2 (dispersion phase). Under conditions where the water delivery capacity of a pump P is set to 40 l/min and a suction amount of the gas F2 is set to 1 l/min, 35 litters of mixed fluid F3 is generated for every 1 minute.

A size (particle size) of super-micro bubbles contained in the mixed fluid F3 generated in this experiment is measured using a laser diffraction particle size distribution measuring device (SALD-2200 made by Shimadzu Corp). A result of the measurement is shown in FIG. 20.

Figure 20:
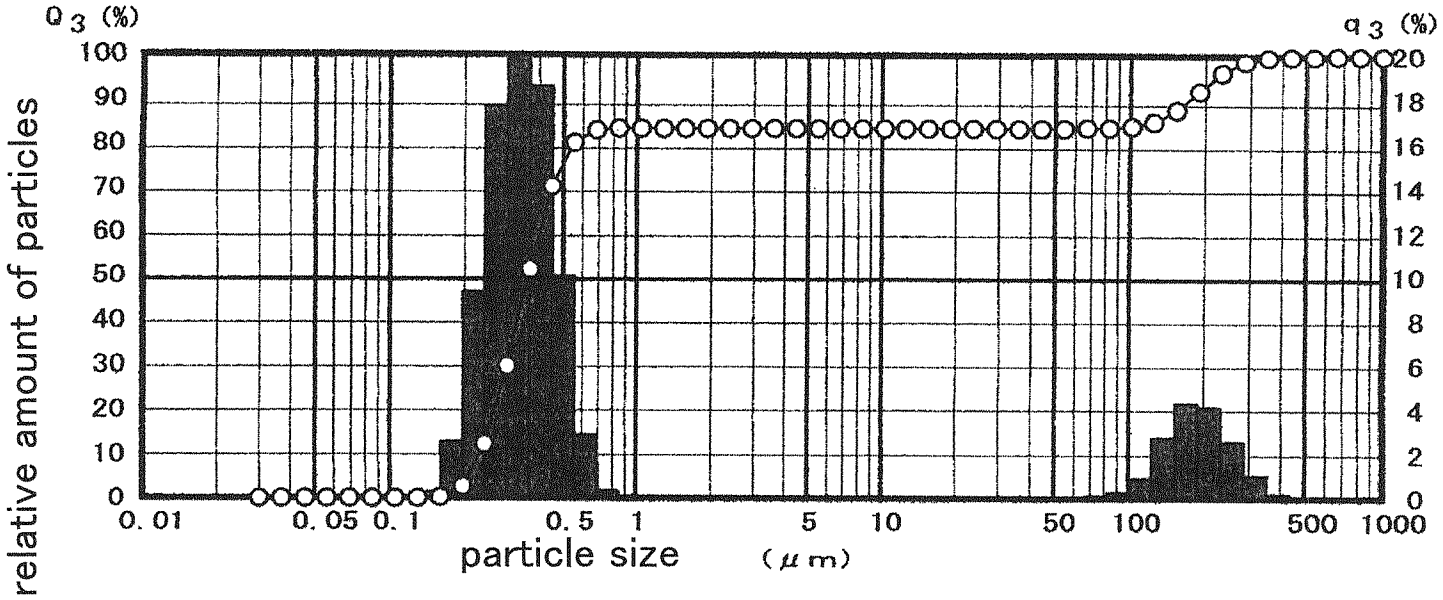
FIG. 20 is a graph showing a result of measurement of a particle size of super-micro bubbles which a mixed fluid produced by the super-micro bubble generating device according to the second embodiment contains.

As can be understood from a graph shown in FIG. 20, in this example, with respect to super-micro bubbles contained in the mixed fluid F3, an amount of particles having a particle size of approximately 0.3 μm (300 nm) occupies 80% (relative value) of the total super-micro bubbles.

From this measurement result, it is found that the super-micro bubble generating device 1 of this embodiment possesses the excellent performance that the mixed fluid F3 into which super-micro bubbles of nano-scale are mixed can be generated.

Second Example

In the second example, a self-priming air pressure (kPa) in the super-micro bubble containing liquid producing flow path 91 of the super-micro bubble generating device 1 according to the first embodiment and a self-priming air pressure (kPa) in the super-micro bubble containing liquid producing flow path 91 of the super-micro bubble generating device 1 according to the second embodiment provided with the swirl flow means 61 which constitutes the first modification are respectively detected, and a comparison experiment of an air suction force (self-priming effect) is carried out. Here, city service water is used as a liquid F1 (continuous phase) and outside air (air) is used as a gas F2 (dispersion phase). A twisted angle θ of the swirl flow means 61 is set to 60°.

Figure 21:
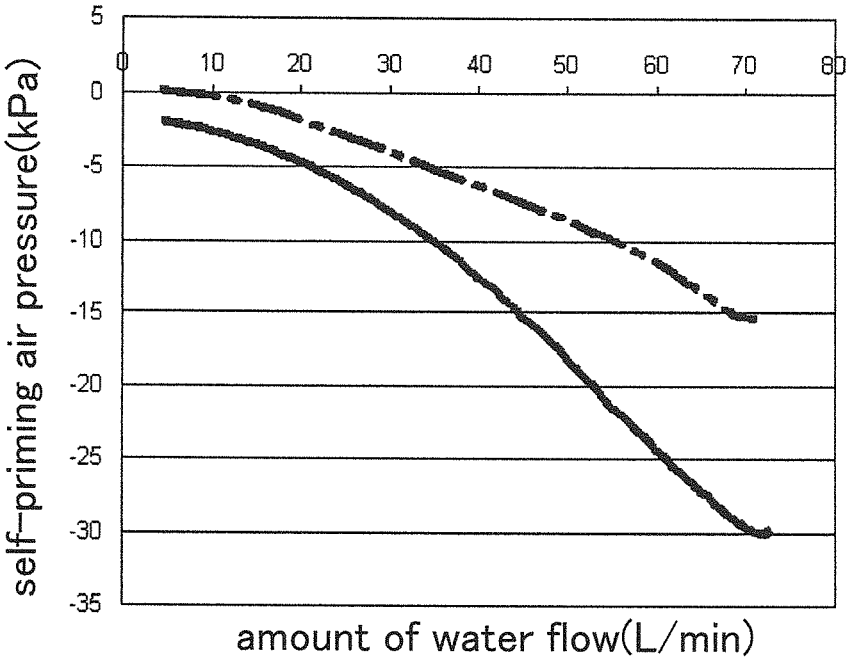
FIG. 21 is a graph showing a result of detecting a self-priming air pressure in a super-micro bubble containing fluid producing flow path of the super-micro bubble generating device according to the first embodiment and a self-priming air pressure in a super-micro bubble containing fluid producing flow path of the super-micro bubble generating device according to the second embodiment provided with the swirl flow means according to the first modification.

In the super-micro bubble generating device 1 according to the first embodiment, a result of measurement shown in a graph indicated by a chained line in FIG. 21 is acquired. At a stage that a flow rate of water (L/min) in the super-micro bubble containing liquid producing flow path 91 exceeds 70 L/min, a self-priming air pressure (kPa) reaches −15 kPa.

To the contrary, in the super-micro bubble generating device 1 according to the second embodiment, a result of measurement shown in a graph indicated by a solid line in FIG. 21 is acquired. At a stage that a flow rate of water (L/min) in the super-micro bubble containing liquid producing flow path 91 exceeds 72 L/min, a self-priming air pressure (kPa) reaches −30 kPa.

As a result, it is found that by providing swirl flow means 61 to the super-micro bubble containing liquid producing flow path 91 thus forming the swirl flow, a force which sucks air (self-priming effect) is increased more compared to the case where the swirl flow means 61 is not provided to the super-micro bubble containing liquid producing flow path 91. Accordingly, it is found that with the provision of the swirl flow means 61, an air intake amount is increased so that the number of bubbles is increased.

REFERENCE SIGNS LIST

1: super-micro bubble generator
2: super-micro bubble generator
3: liquid storing part
4: mixed fluid storing part
30: inlet opening
40: delivery opening
50: casing body
60: swirl flow forming part
70: flow speed increasing part
80: gas suction part
90: super-micro bubble containing liquid producing part

The invention claimed is:

1. A super-micro bubble generator having a super-micro bubble-containing liquid generating part, wherein an introduction opening for introduction of a liquid is formed at one end of a cylindrical casing body and a delivery opening for delivery of a super-micro bubble-containing liquid is formed at the other end of the cylindrical casing body, the cylindrical casing body having a first division member having a cylindrical shape having a uniform first inner diameter along its length, a flow speed increasing part for increasing a flow speed of the liquid is formed in the inside of the casing body in a direction toward the delivery opening from the introduction opening, a gas suction part for sucking a gas into the casing body from the outside is formed in the inside of a middle portion of the casing body where a negative pressure is generated due to the liquid whose flow speed is increased by the flow speed increasing part, and the super-micro bubble-containing liquid generating part is formed in the inside of the casing body where the gas sucked by the negative pressure in the gas suction part is sheared by the liquid thus generating a super-micro bubble-containing liquid, wherein the flow speed increasing part is formed by disposing the cylindrical casing body and a cylindrical flow path forming member concentrically, the cylindrical flow path forming member having a first outer diameter, the first outer diameter being smaller than the first inner diameter and being spaced apart from an inner wall surface of said cylindrical casing body, a first gap being formed between the first outer diameter of the cylindrical flow path forming member and the inner wall surface of the cylindrical casing body, the cylindrical flow path forming member being disposed substantially within the cylindrical casing body, a flow path cross section of the flow path forming member is set smaller than a flow path cross section of the casing body, and a flow speed increasing flow path is formed in a coaxially extending manner on a distal end of the flow path forming member, the gas suction part is configured to suck a gas outside the super-micro bubble generator by a negative pressure due to a suction opening formed in a middle portion of a peripheral wall of the casing body, and a flow path cylinder which forms the flow speed increasing flow path therein is concentrically inserted into the inside of a distal end portion of the casing body, thus forming a cylindrical gas suction flow path in the gap between the flow path cylinder and the inside of the casing body, the super-micro bubble-containing liquid generating part is configured such that a super-micro bubble-containing liquid generating cylindrical flow path is formed in a direction away from the flow speed increasing flow path whereby, in the inside of the super-micro bubble-containing liquid generating cylindrical flow path, the gas which is sucked from a proximal end opening of the circumferentially formed gas suction flow path and is discharged circumferentially from a distal end opening of the circumferentially formed gas suction flow path and a liquid which flows out into a hollow portion of the cylindrical gas from a distal end of the flow speed increasing flow path as a speed increased liquid flow are merged so that the cylindrical gas flow which is disposed around the liquid is entrapped and mixed into the liquid and a shearing action is generated during mixing of the liquid so that a super-micro bubble-containing liquid is generated and delivered from the delivery port;

a swirl flow forming part for forming the liquid which passes through the cylindrical casing body into a swirl flow, which is disposed in the cylindrical casing body at a position remote from the flow path forming member, the swirl flow forming part being spaced from a flow entry rim of the cylindrical flow path forming member along said uniform first inner diameter by a distance greater than the first inner diameter of said cylindrical casing body; and the swirl flow forming part further comprising:

a rod-shaped core portion including a plurality of arcuate recessed surfaces extending diagonally along a lateral surface of the rod-shaped core portion.

2. The super-micro bubble generator according to claim 1, wherein the casing body comprises: a second division member having a cylindrical shape which is fitted on a distal end portion of an outer peripheral surface of the first division member; a third division member having a cylindrical shape which is fitted on a distal end portion of an inner peripheral surface of the second division member; a fourth division member having a cylindrical shape which is fitted on a distal end portion of an outer peripheral surface of the third division member; and a fifth division member having a cylindrical shape which is fitted on a distal end portion of an inner peripheral surface of the fourth division member, wherein the fourth division member is formed with a diameter thereof at a distal end portion side set smaller than the diameter thereof at a proximal end portion side with a diameter decreasing portion which constitutes a middle portion of the fourth division member interposed between the distal end portion side and the proximal end portion side, the swirl flow forming part further comprising: a support member having a cylindrical shape which is fitted on a middle portion of the inner peripheral surface of the second division member, the support member being sandwiched in the axial direction by the first division member and the third division member in the inside of the second division member, the flow speed increasing flow path is formed by arranging the flow speed increasing part which comprises: a flow path forming member having a cylindrical shape which has an outer diameter thereof smaller than an inner diameter of the distal end portion side of the fourth division member, the flow path forming member having the first outer diameter, the first outer diameter being smaller than the first inner diameter and being spaced apart from an inner wall surface of said first division member, the first gap being formed between the first outer diameter of the cylindrical flow path forming member and the inner wall surface of the first division member, the flow path forming member being disposed substantially within the first division member; and an umbrella-shaped support member which is formed in a projecting manner toward a downstream side from a proximal end portion of an outer peripheral surface of the flow path forming member in the inside of the fourth division member, a peripheral portion of a distal end of the umbrella-shaped support member is brought into contact with the diameter decreasing portion of the fourth division member, and a distal end portion of the flow path forming member is arranged concentrically in the inside of the distal end portion of the fourth division member, and the gas suction flow path is formed of a second gap formed between an outer peripheral surface of the flow path forming member and an inner peripheral surface of the distal end portion of the fourth division member and a third gap formed between the outer peripheral surface of the flow path forming member and an inner peripheral surface of the distal end portion of the fifth division member, and the gas suction flow path is formed in a cylindrical shape on the outer periphery of the flow speed increasing flow path on a distal end portion side, wherein the swirl flow forming part being spaced from a flow entry rim of the cylindrical flow path forming member along said uniform first inner diameter by a distance greater than the first inner diameter.

* * * * *